US009188929B2

(12) United States Patent
Oohara et al.

(10) Patent No.: US 9,188,929 B2
(45) Date of Patent: Nov. 17, 2015

(54) CURL STRAIGHTENING METHOD AND IMAGE FORMING APPARATUS

(71) Applicants: Shunichi Oohara, Kanagawa (JP); Yuko Hayama, Kanagawa (JP)

(72) Inventors: Shunichi Oohara, Kanagawa (JP); Yuko Hayama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 16 days.

(21) Appl. No.: 14/138,315

(22) Filed: Dec. 23, 2013

(65) Prior Publication Data

US 2014/0234002 A1 Aug. 21, 2014

(30) Foreign Application Priority Data

Feb. 19, 2013 (JP) ..... 2013-030192

(51) Int. Cl.

*B65H 23/34* (2006.01)
*G03G 21/00* (2006.01)
*G03G 15/00* (2006.01)

(52) U.S. Cl.

CPC ..... *G03G 15/6576* (2013.01); *G03G 15/5029* (2013.01); *B65H 2301/5121* (2013.01); *B65H 2301/51256* (2013.01); *G03G 2215/00662* (2013.01); *G03G 2215/00704* (2013.01); *G03G 2215/00772* (2013.01); *G03G 2215/00776* (2013.01)

(58) Field of Classification Search

CPC ..... G03G 15/235; G03G 15/6573; G03G 2215/00704; G03G 2215/00662; B65H 2301/5121; B65H 23/34

See application file for complete search history.

(56) References Cited

U.S. PATENT DOCUMENTS 5,414,503 A * 5/1995 Siegel et al. ..... 399/406
5,920,751 A * 7/1999 Chow et al. ..... 399/97
2007/0132174 A1* 6/2007 Yamane et al. ..... 271/188

FOREIGN PATENT DOCUMENTS

JP 2002-316761 10/2002
JP 2011-081341 4/2011
JP 2012-242625 12/2012

OTHER PUBLICATIONS

Tomoyuki Ito et al., "Simulation Model of Paper Curl Formed by Transportation Path", Journal of the Imaging Society of Japan, vol. 51, No. 3, pp. 248-254 (2012), 19 pages (with English Translation).

* cited by examiner

*Primary Examiner* — Blake A Tankersley
*Assistant Examiner* — John M Royston
(74) *Attorney, Agent, or Firm* — Oblon, McClelland, Maier & Neustadt, L.L.P.

(57) ABSTRACT

A curl straightening method in an image apparatus including a fixing apparatus and a curl straightening apparatus is disclosed. The method includes calculating moisture content of a sheet before being supplied to the fixing apparatus; measuring a temperature of a heating unit and a pressurizing unit; calculating a temperature and moisture content of the sheet in the respective conveying sections; calculating a conveying time of the sheet in the respective conveying sections; calculating a residual strain of the sheet in the respective conveying sections from the calculated temperature and the moisture content of the sheet in the respective conveying sections, the calculated conveying time, and the stress relaxation characteristics of the sheet; calculating a final curl amount using the calculated residual strain of the sheet in the respective conveying sections; and controlling the curl straightening apparatus based on the final curl amount obtained.

4 Claims, 14 Drawing Sheets

FIG.7

| PAPER -TYPE | PAPER MOISTURE CONTENT M(%) / PAPER TEMPERATURE T(℃) | M≦4 | | 4<M≦6 | | ··· | | 16<M | |
|---|---|---|---|---|---|---|---|---|---|
| PAPER I1 | T≦20 | Sz | Sz111 | Sz | Sz112 | Sz | ··· | Sz | Sz11m |
| | | S1,S2, S3,S4 | Si111 | S1,S2, S3,S4 | Si112 | S1,S2, S3,S4 | ··· | S1,S2, S3,S4 | Si11m |
| | | τ1 | τ1111 | τ1 | τ1112 | τ1 | ··· | τ1 | τ111m |
| | | τ2 | τ2111 | τ2 | τ2112 | τ2 | ··· | τ2 | τ211m |
| | | τ3 | τ3111 | τ3 | τ3112 | τ3 | ··· | τ3 | τ311m |
| | | τ4 | τ4111 | τ4 | τ4112 | τ4 | ··· | τ4 | τ411m |
| | 20<T≦40 | Sz | Sz121 | Sz | Sz122 | ··· | | Sz | Sz12m |
| | | S1,S2, S3,S4 | Si121 | S1,S2, S3,S4 | Si122 | ··· | | S1,S2, S3,S4 | Si12m |
| | | τ1 | τ1121 | τ1 | τ1122 | ··· | | τ1 | τ112m |
| | | τ2 | τ2121 | τ2 | τ2122 | ··· | | τ2 | τ212m |
| | | τ3 | τ3121 | τ3 | τ3122 | ··· | | τ3 | τ312m |
| | | τ4 | τ4121 | τ4 | τ4122 | ··· | | τ4 | τ412m |
| | ··· | ··· | | ··· | | ··· | | ··· | |
| | 100<T | Sz | Sz1n1 | ··· | | ··· | | Sz | Sz1nm |
| | | S1,S2, S3,S4 | Si1n1 | ··· | | ··· | | S1,S2, S3,S4 | Si1nm |
| | | τ1 | τ11n1 | ··· | | ··· | | τ1 | τ11nm |
| | | τ2 | τ21n1 | ··· | | ··· | | τ2 | τ21nm |
| | | τ3 | τ31n1 | ··· | | ··· | | τ3 | τ31nm |
| | | τ4 | τ41n1 | ··· | | ··· | | τ4 | τ41nm |
| | T≦20 | ··· | | ··· | | ··· | | ··· | |
| ··· | 20<T≦40 | ··· | | ··· | | ··· | | ··· | |
| | ··· | ··· | | ··· | | ··· | | ··· | |
| | 100<T | ··· | | ··· | | ··· | | ··· | |
| PAPER In | T≦20 | ··· | | ··· | | ··· | | ··· | |
| | 20<T≦40 | ··· | | ··· | | ··· | | ··· | |
| | ··· | ··· | | ··· | | ··· | | ··· | |
| | 100<T | Sz | Sz1n1 | ··· | | ··· | | Sz | Szinm |
| | | S1,S2, S3,S4 | Si1n1 | ··· | | ··· | | S1,S2, S3,S4 | Siinm |
| | | τ1 | τ11n1 | ··· | | ··· | | τ1 | τ1inm |
| | | τ2 | τ21n1 | ··· | | ··· | | τ2 | τ2inm |
| | | τ3 | τ31n1 | ··· | | ··· | | τ3 | τ3inm |
| | | τ4 | τ41n1 | ··· | | ··· | | τ4 | τ4inm |

CURL STRAIGHTENING METHOD AND IMAGE FORMING APPARATUS

TECHNICAL FIELD

The present invention relates to curl straightening methods and image forming apparatuses.

BACKGROUND ART

In various related art image forming apparatuses, in order to fix toner onto a sheet or to dry ink, a fixing apparatus may be arranged which includes a heating unit and a pressurizing unit downstream of an image forming unit which forms an image onto the sheet. In the fixing apparatus, a nip portion which places the sheet between the heating unit and the pressurizing unit may be configured in an arc shape in order to make it possible to heat the sheet for a sufficient time and the sheet may be bent to the pressurizing member side at an outlet of the nip portion in order to make it possible for the sheet to be peeled off well from a fixing member.

Moreover, as the sheet is conveyed onto a paper-discharging tray which is arranged such that the sheet is easily taken out therefrom while keeping an installation area of an apparatus in question small, a sheet conveying path up to a point at which the sheet is discharged onto the paper-discharging tray from the fixing apparatus is configured by combining multiple bent conveying paths.

As the sheet is generally a viscoelastic body, stress is relaxed when strain is provided thereto, so that residual strain is produced. Therefore, when the sheet passes through the conveying path or the fixing apparatus including the above-described bent portion, strain remains in the bent portion, forming a curl. When a curled sheet of paper is conveyed through the conveying path and discharged, it becomes more likely for a paper jam in the conveying path after fixing and bulking, etc., in storage in the paper-discharging tray to occur. Therefore, in order to straighten such a curl which occurs in the conveying path or at the time of fixing, a curl straightening apparatus may be used on the conveying path of the sheet.

Curl straightening apparatuses are known which include a pressing roller and a roller or a belt, for example, and which straightens the curl of the sheet by causing the sheet to pass through the nip portion formed by pressing the roller or the belt by the pressing roller.

In order to properly remove the curl in such a curl straightening apparatus, it is necessary to control the amount of straightening. In this way, no technique is known which accurately projects an amount of curl produced that varies depending on operating conditions of the image forming apparatus. Therefore, a curl straightening method which makes it possible to stably reduce curl is not known since problems occur such that a curl suppressing effect is low compared to an actual curl amount or that a greater adjustment of the suppressing effect causes it to be excessive on the contrary, causing a curl on the reverse side.

DISCLOSURE OF THE INVENTION

In light of the above-mentioned problems of the related art, an object of the present invention is to provide a curl straightening method which can project an amount of curl produced in response to changes in factors which affect production of the curl with changes in operating conditions of an image forming apparatus and realize curl straightening in accordance therewith.

According to an embodiment of the present invention, a curl straightening method is provided in an image apparatus including a fixing apparatus which includes a nip portion formed by a heating unit which heats one face side of a sheet and a pressurizing unit which presses the sheet to the heating unit side and a curl straightening apparatus which is arranged on a conveying path of the sheet from the fixing apparatus to a paper-discharging outlet to straighten a curl of the sheet. The curl straightening method includes a sheet moisture content calculating step of calculating moisture content of the sheet before being supplied to the fixing apparatus; a temperature measuring step of measuring a temperature of the heating unit and the pressurizing unit; a sheet temperature/moisture content calculating step of calculating a temperature and moisture content of the sheet in the respective conveying sections of multiple conveying sections into which are divided a conveying path from the nip portion to the paper-discharging outlet such that a curvature rate of the conveying path in the respective conveying sections is constant; a conveying time calculating step of calculating a conveying time of the sheet in the respective conveying sections; a conveying section strain calculating step of calculating a residual strain of the sheet in the respective conveying sections from the temperature and the moisture content of the sheet in the respective conveying sections that are calculated in the sheet temperature/moisture content calculating step, the conveying time calculated in the conveying time calculating step, and the stress relaxation characteristics of the sheet; a final curl amount calculating step of calculating a final curl amount using the residual strain of the sheet in the respective conveying sections that is calculated in the conveying section strain calculating step; and a curl straightening apparatus controlling step of controlling the curl straightening apparatus based on the final curl amount obtained in the final curl amount calculating step.

The present invention makes it possible to provide a curl straightening method which can project an amount of curl produced in response to changes in factors which affect production of the curl with changes in operating conditions of an image forming apparatus and realize curl straightening in accordance therewith.

BRIEF DESCRIPTION OF THE DRAWINGS

Other objects, features, and advantages of the present invention will become more apparent from the following detailed descriptions when read in conjunction with the accompanying drawings, in which:

FIG. 7 is a diagram illustrating an exemplary stress relaxation characteristics table according to the embodiment of the present invention;

BEST MODE FOR CARRYING OUT THE INVENTION

Figure 1:
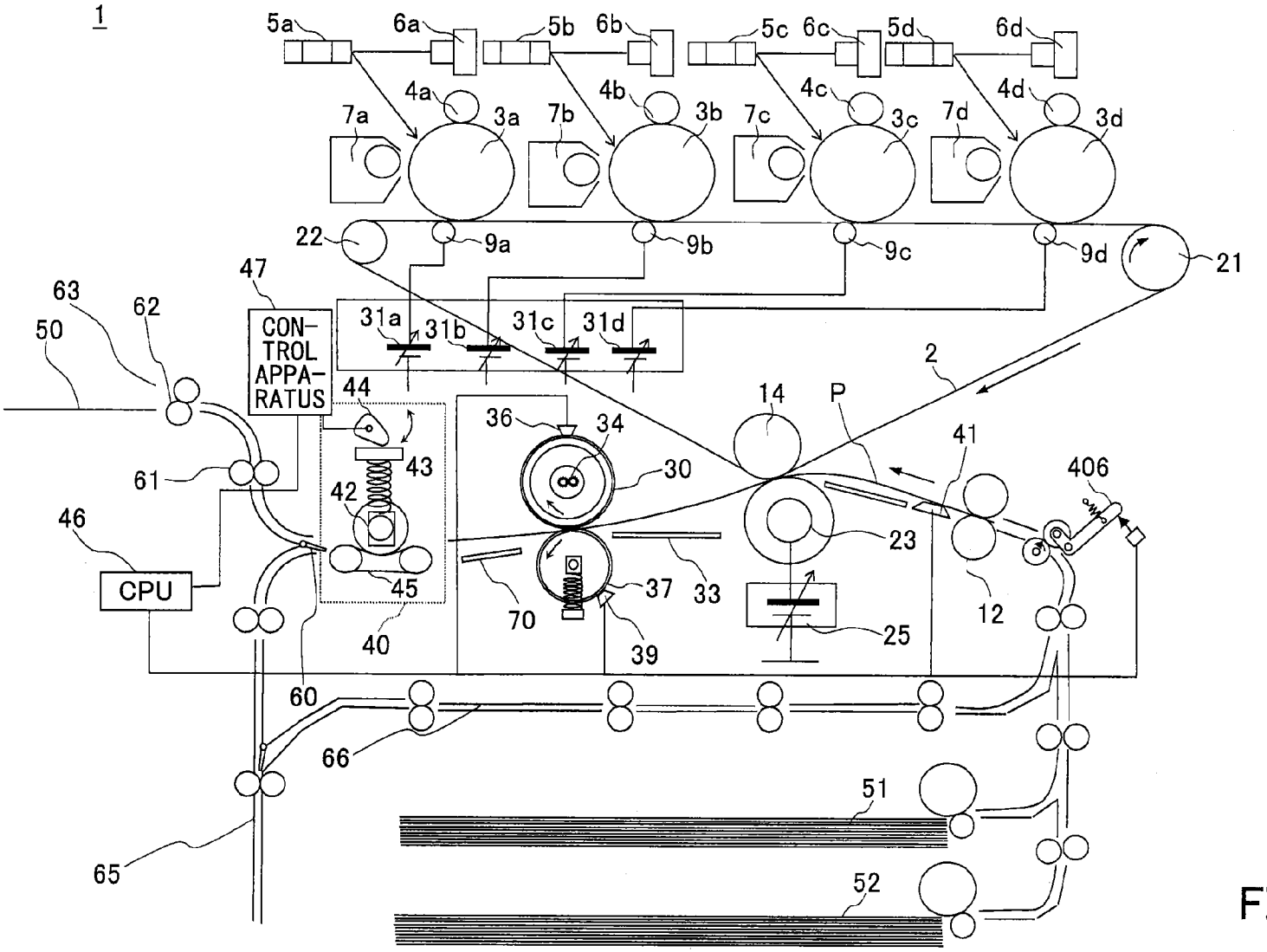
FIG. 1 is an explanatory diagram of an exemplary configuration of an image forming apparatus according to an embodiment of the present invention.

Below, embodiments for carrying out the present invention are described with reference to the drawings. In the respective drawings, the same letters are applied to the same elements, so that duplicate explanations may be omitted.

While embodiments for carrying out the invention are described below using the drawings, the present invention is not to be limited by these examples.

In the present embodiments, exemplary configurations of a curl straightening method and an image forming apparatus of the present invention are described.

The curl straightening method of the present invention may be applied in the image forming apparatus having a curl straightening apparatus and a fixing apparatus. More specifically, the fixing apparatus includes a nip portion formed by a heating unit which heats the one face side of a sheet; and a pressurizing unit which presses the sheet onto the heating unit side. Moreover, the curl straightening apparatus, which is arranged on a conveying path of the sheet from the fixing apparatus to a sheet-discharging outlet, is configured to straighten a curl of the sheet.

Then, the curl straightening method of the present invention includes the following respective steps:

- a sheet moisture content calculating step which calculates moisture content of the sheet before being supplied to the fixing apparatus;
- a temperature measuring step which measures a temperature of the heating unit and the pressurizing unit;
- a sheet temperature/moisture content calculating step which calculates the temperature and the moisture content of the sheet in the respective conveying sections of multiple conveying sections into which the conveying path from the nip portion to the sheet-discharging outlet is divided such that the curvature of the conveying path in the respective conveying sections is constant;
- a conveying time calculating step which calculates a conveying time of the sheet in the respective conveying sections;
- a conveying section strain calculating step which calculates residual strain of the sheet in the respective conveying sections from the stress relaxation characteristics of the sheet; the conveying time calculated in the conveying time calculating step; and the temperature and the moisture content of the sheet in the respective conveying sections calculated in the sheet temperature/moisture content calculating step;
- a final curl amount calculating step which calculates a final curl amount using residual strain of the sheet in the respective conveying sections calculated in the conveying section strain calculating step; and
- a curl straightening apparatus control step which controls a curl straightening apparatus based on the final curl amount obtained in the final curl amount calculating step.

The image forming apparatus according to the present embodiment includes a fixing apparatus including a nip portion formed by a heating unit which heats the one face side of the sheet; and a pressurizing unit which presses the sheet onto the heating unit side. Moreover, the image forming apparatus includes a curl straightening apparatus which is arranged on the conveying path of the sheet from the fixing apparatus to the sheet-discharging outlet and which is configured to straighten the curl of the sheet.

Then, the image forming apparatus may be configured to include the following units:

- a sheet moisture content calculating unit which calculates moisture content of the sheet before being supplied to the fixing apparatus;
- a temperature sensor on the heating unit side that measures a temperature of the heating unit and a temperature sensor on the pressurizing unit side that measures a temperature of the pressurizing unit;
- a sheet temperature/moisture content calculating unit which calculates the moisture content and the temperature of the sheet in the respective conveying sections of multiple conveying sections in which a conveying path from the nip portion to the sheet-discharging outlet is divided such that the curvature rate of the conveying path in the respective conveying sections is constant;
- a conveying time calculating unit which calculates a conveying time of the sheet in the respective conveying sections;
- a conveying section strain calculating unit which calculates residual strain of the sheet in the respective conveying sections from the stress relaxation characteristics of the sheet; the conveying time calculated in the conveying time calculating unit; the temperature and the moisture content of the sheet in the respective conveying sections that are calculated in the sheet temperature/moisture content calculating unit;
- a final curl amount calculating unit which calculates a final curl amount using residual strain of the sheet in the respective conveying sections that is calculated in the conveying section strain calculating unit;
- a curl straightening apparatus control value determining unit which determines a control value of a curl straightening apparatus based on a final curl amount calculated by the final curl amount calculating unit; and
- a curl straightening apparatus control unit which controls the curl straightening apparatus based on a control value determined by the curl straightening apparatus control value determining unit.

First, an exemplary configuration of an image forming apparatus to which is applied a curl straightening method according to the present embodiment and the image forming apparatus according to the present embodiment is described using FIG. 1.

FIG. 1 illustrates an exemplary configuration of an image forming apparatus which carries out the curl straightening method of the present embodiment. While an image forming apparatus 1 illustrated in FIG. 1 shows an image forming apparatus having a so-called "tandem configuration", it is not limited to the above-described image forming apparatus, so that it may be applied to an image forming apparatus having a curl straightening apparatus and a fixing apparatus. For example, it may be applied to various image forming apparatuses such as an inkjet image forming apparatus, other color or monochrome electro-photographic image forming apparatus, etc.

The image forming apparatus 1 shown in FIG. 1 is provided with photosensitive drums 3*a*-3*d* for each color of black (K), magenta (M), cyan (C), and yellow (Y) along an intermediate transfer belt 2. Then, in the surroundings of each photosensitive drum 3*a*-3*d* are arranged charging rollers 4*a*-4*d* which provides electric charges; light irradiating apparatuses 6*a*-6*d* such as a laser diode, an LED, etc.; and polygon mirrors 5*a*-5*d* which scan a light beam in a main scanning direction of the photosensitive drums 3. Moreover, developing apparatuses 7*a*-7*d* which hold a developing solution are provided. In the image forming apparatus 1, in the image forming process, first, negative electric charges are provided onto the photosensitive drums 3*a*-3*d* by charging rollers 4*a*-4*d*, respectively, thereby uniformly charging them. Then, light beams are output from light irradiating apparatuses 6*a*-6*d* in accordance with the writing image signal, irradiated onto a surface of the charged photosensitive drums 3*a*-3*d* via optics including the polygon mirrors 5*a*-5*d*, and an electric potential distribution is written thereto in accordance with an exposure amount and presence/absence of irradiation of the light beams. An electrostatic latent image to be written is formed by controlling the "on" and "off" of an optical beam in accordance with a write signal of black (K), magenta (M), cyan (C), and yellow (Y), which are base toner colors produced after processing data transmitted from a personal computer, etc. Each electrostatic latent image formed is conveyed to the development apparatus 7*a*-7*d* directions as each photosensitive drum 3*a*-3*d* rotates and is developed by the toner. Then, the toner image in accordance with the write signal is formed and supported on the photosensitive drums 3*a*-3*d*.

On the other hand, below the photosensitive drums 3*a*-3*d* is arranged, as an intermediate transfer body, an intermediate transfer belt 2 which is stretched between rollers 21 and 22. The intermediate transfer belt 2 is rotated in an arrow direction (shown), rollers 9*a*-9*d* are in contact on the back side thereof, and a primary bias is applied by power supplies 31*a*-31*d* connected to the respectively corresponding rollers 9*a*-9*d*. A toner image is conveyed to the intermediate transfer belt 2 side as the photosensitive drums 3*a*-3*d* rotate, and transferred onto the intermediate transfer belt 2 at a position at which the photosensitive drums 3*a*-3*d* and the intermediate transfer belt 2 come into contact. The toner images of the respective colors are superposed with their positions aligned, and multi-color toner images are formed on the intermediate transfer belt 2. After remaining toner on an outer peripheral face is wiped off by a photosensitive drum cleaner (not shown), static electricity of a portion for which transferring of the toner image of the photosensitive drums 3*a*-3*d* is completed is eliminated by a static-eliminating apparatus, and supplied to the following image forming process. The multi-color toner image transferred onto the intermediate transfer belt 2 is conveyed toward the transfer roller 23 of a secondary transfer unit. On the other hand, a sheet set in a paper-feeding cassette 51 or a paper-feeding cassette 52 is fed toward the transfer roller 23 at a set timing and sent from where the conveying roller 12 is at an appropriate timing in alignment with image writing.

Here, a sheet thickness detecting sensor 406 which detects the thickness of the sheet may be arranged on a conveying path between the conveying roller 12 and the paper-feeding cassettes 51 and 52. Moreover, a temperature/humidity sensor 41 which measures the temperature and the humidity near a sheet surface may be arranged between the conveying roller 12 and the transfer roller 23.

Figure 2:
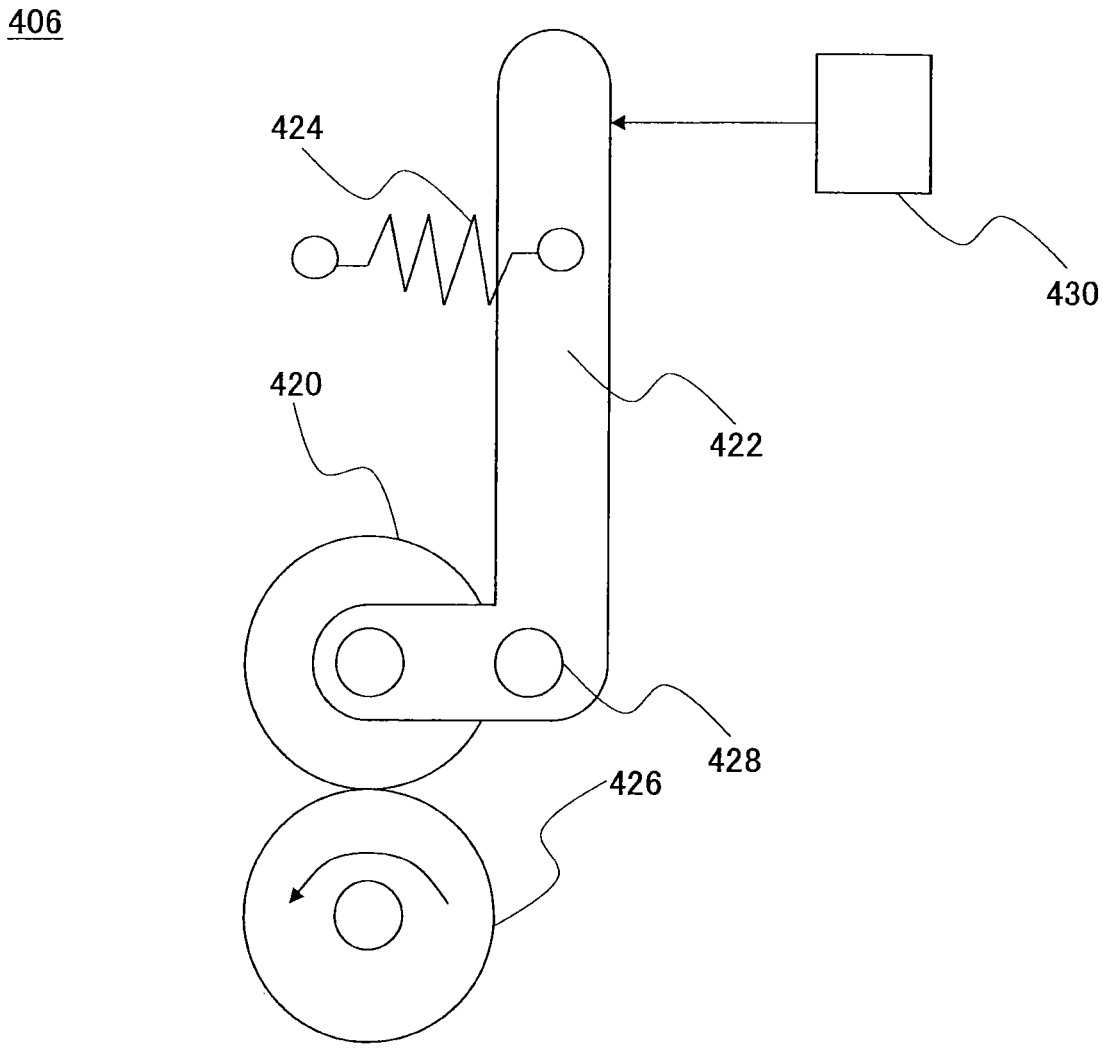
FIG. 2 is an explanatory diagram of an exemplary configuration of a sheet thickness sensor according to the embodiment of the present invention.

An exemplary configuration of the sheet thickness detecting sensor 406 is described using FIG. 2.

FIG. 2 is a diagram illustrating an exemplary configuration of the sheet thickness detecting sensor which may be preferably used according to the present embodiment. The sheet thickness detecting sensor 406 may be configured to include a thickness detecting roller 420; a thickness detecting lever 422; and a drive roller 426, as illustrated in FIG. 2, for example. The thickness detecting sensor 420 is mounted to the thickness detecting lever 422, and pressed against the drive roller 426 by a spring 424. The thickness detecting lever 422 is rotatably supported around a pivot 428. The drive roller 426 is rotated in an arrow direction (shown) by a drive unit (not shown) and conveys the sheet. A displacement sensor 430 measures the rotating displacement of the thickness detecting lever 422. The drive roller 426 is desirably a rubber roller in order to maintain a friction driving force for conveying the sheet and is desirably of a hardness of at least 50 degrees (Asker A type) in order to increase thickness detecting accuracy.

When the sheet goes between the drive roller 426 and the thickness detecting roller 420, the thickness detecting roller 420 is pushed up, and the thickness detecting lever 422 rotates. As the distance between the thickness detecting lever 422 and the displacement sensor 430 changes, an output value in accordance with a thickness of the sheet is output from the displacement sensor 430, thereby making it possible to detect the thickness of a sheet which passed therethrough.

As described later, a value of the thickness of the sheet that is used when calculating a curl amount does not have to be in accordance with the sheet thickness detecting sensor 406 described here, so that information stored in the image forming apparatus 1 or information input by an operator may also be used. When the sheet thickness detecting sensor 406 is used in this way, the apparatus itself measures the thickness of the sheet, so that the burden to an operator, such as inputting a thickness value of paper for each cassette is reduced, improving operability. Moreover, a straightening failure due to an inputting error may also be prevented, which is desirable.

For the sheet thickness detecting sensor 406, which is an arbitrary configuration as described above, information such as paper type, thickness, etc., that are input from an external personal computer apparatus, or from an operator without providing the thickness detecting sensor may be used.

The temperature/humidity sensor 41 may be what can measure the temperature or the humidity of the sheet being conveyed, so that the type thereof is not limited in particular. For example, it may be configured from a humidity sensor and a temperature sensor. In this case, with the humidity sensor, by forming a capacitor with a polymer film as a dielectric, a capacitive humidity sensor may be used which converts moisture absorption and desorption to an electric signal as a change in capacitance. Moreover, an electrical resistance-type humidity sensor in which an electrode is configured with a stable metal and a moisture-sensitive polymer material on a base substrate and a change in resistance due to moisture at the electrode is converted to an electrical signal may also be used.

Moreover, the temperature sensor may be selected in accordance with a predetermined detection temperature range, so that a thermistor, a band-gap type temperature sensor, etc., may be used.

The temperature/humidity sensor 41 and the sheet thickness detecting sensor 406 may be arranged at a location on the sheet conveying path, up to which location the sheet is supplied to the curl straightening apparatus 40 and such an arrangement is not limited to the above-described location. They are preferably provided near the curl straightening apparatus and are preferably provided at the above-described location with respect to a layout of the apparatus. Moreover, there is no problem in arranging the temperature/humidity sensor 41 and the sheet thickness detecting sensor 406 such that they are swapped with each other in the sheet conveying direction.

Electric charges are supplied from the power supply 25 to the transfer roller 23; Together with the roller 14, the transfer roller 23 collectively transfers the toner images on the intermediate transfer belt 2 onto the fed sheet. The sheet is conveyed to a position which is in contact with the intermediate transfer belt 2 and receives transferring of the multicolor toner image. The sheet on which the multicolor toner image is formed is supplied to a nip portion between a pressurizing roller 37, which is a pressurizing unit, and a heating roller 30, which is a heating unit of the fixing apparatus. Then, the sheet and the multicolor toner image are heated and pressurized, and the multicolor toner image is fixed onto the sheet.

Here, while examples are described using the heating roller 30 and the pressuring roller 37 as the heating unit and the pressurizing unit of the fixing apparatus, respectively, the heating unit and the pressurizing unit are not limited to such embodiments. They may be units which allow toner formed on the sheet to be fixed or which allow ink to be dried when the sheet passes through a nip portion formed by the heating unit and the pressurizing unit. For example, the heating unit and/or the pressurizing unit may also be configured by a belt, or, more specifically, a belt stretched between belt-supporting rollers, for example. After being subjected to curl straightening by the curl straightening apparatus 40, the fixed sheet is discharged onto a paper-discharging tray 50 from a paper-discharging outlet configured by a paper-discharging roller 62 along a predetermined conveying path.

On the other hand, after the multicolor toner image is transferred, the intermediate transfer belt 2 has remaining toner solution removed thereon by a cleaning blade (not shown), etc., removed, after which it is supplied to the following image forming process. When printing is conducted also onto a back face of the sheet, a conveying path may be switched by a flap 60, the fixed sheet is guided to a reverse conveying path 65, the front and the back of the sheet are reversed to convey the reversed sheet via a double-face conveying path 66 to return to the sheet-conveying path and also form an image onto the back face.

Figure 3:
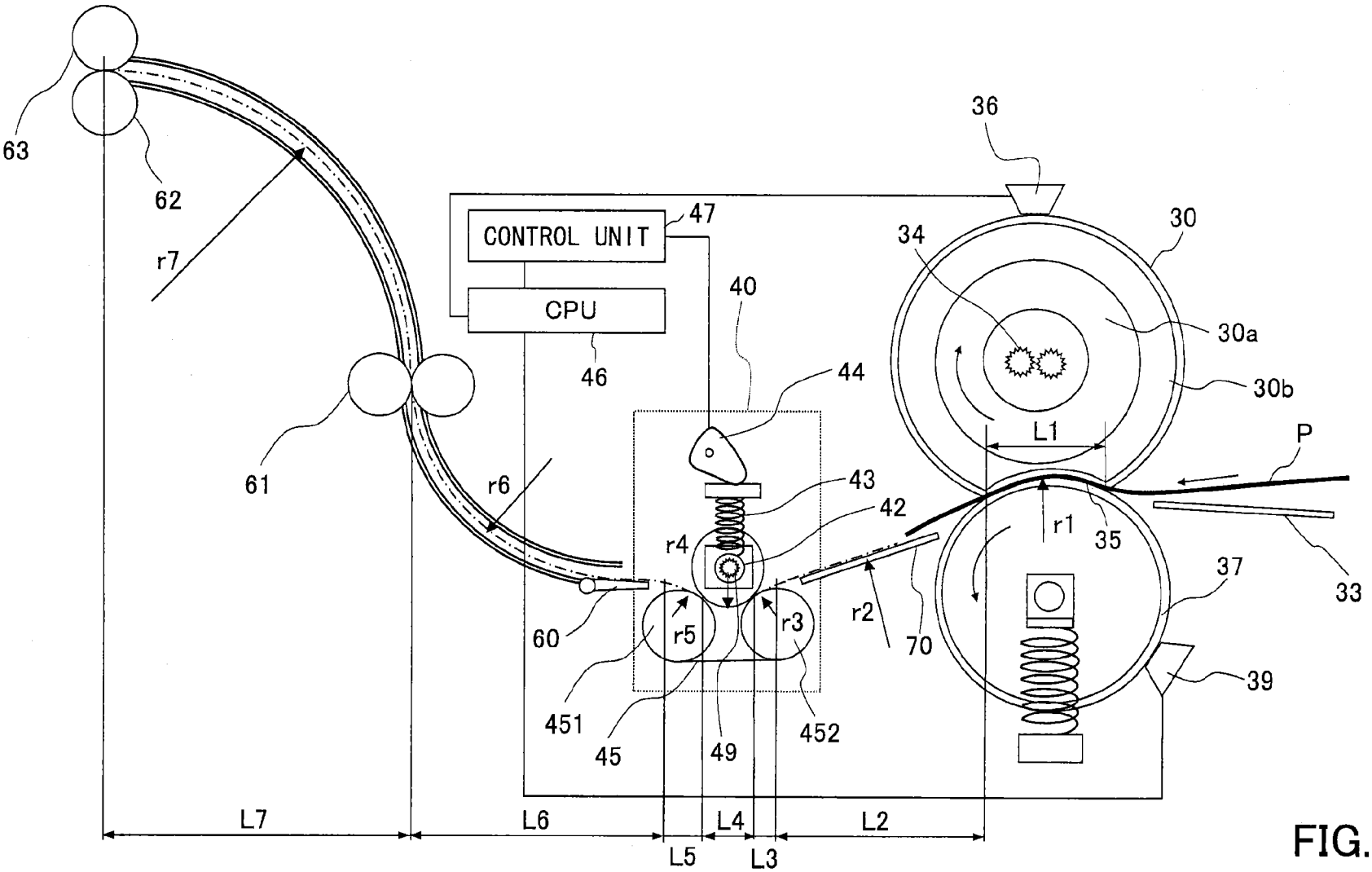
FIG. 3 is an explanatory diagram of an exemplary configuration of a curl straightening apparatus and a fixing apparatus of the image forming apparatus according to the embodiment of the present invention.

Next, FIG. 3 is used to describe an exemplary configuration of a curl straightening apparatus 40 and a fixing apparatus. FIG. 3 illustrates a schematic configuration around the curl straightening apparatus and the fixing apparatus according to the image forming apparatus of the present embodiment. The fixing apparatus according to the present embodiment includes the heating unit and the pressurizing unit as shown in FIG. 3. In FIG. 3, while an example is shown in which a heating roller 30 as the heating unit and a pressurizing roller 37 opposing the heating roller 30 as the pressurizing unit are used, it is not limited to the above-described embodiments, so that it may be configured to heat and pressurize the sheet. For example, a belt-shaped one may also be adopted as the heating unit and/or the pressurizing unit as already described. When the heating roller 30 is used as a heating unit, the configuration is not limited; for example, it is configured to form a resin layer 30*b* such as a fluorosis (PFA), etc., which has heat resistance on a surrounding face of a pipe-shaped core 30*a* and which is superior in mold reliability, for example. Then, it is configured to provide the heater 34 inside the pipe-shaped core 30*a* and arrange a heating unit side temperature sensor 36 in contact with a surrounding face of the resin layer 30*b*. The heater 34 is not particularly limited, so that any kind such as a halogen heater, an electromagnetic induction heater, etc., may also be used.

Moreover, when the pressurizing roller 37 is used as a pressurizing unit, the configuration is not particularly limited; it may be configured to form a resin layer 30*b* such as the fluorosis (PFA), etc., which has heat resistance on a surface thereof and which is superior in mold reliability. Then, it may be configured to be pushed against the heating roller 30 and to form the nip portion 35. While a unit which presses the pressurizing roller 37 against the heating roller 30 is not particularly limited, it may be configured to provide the pressing by a spring as shown in FIG. 3, for example. The heating roller 30 and the pressurizing roller 37 rotate in a direction shown with an arrow in FIG. 3, and convey and pass the sheet P to the nip portion 35 which is abutted by these. An inlet guide 33 which directs a tip of the sheet to the nip portion 35 is provided on the sheet inlet side of the nip portion 35. The above-described fixing apparatus guides the sheet P on which the image is transferred with the inlet guide 33, causes the sheet P to pass through the nip portion 35 formed by the heating roller 30 and the pressurizing roller 37, and causes the transferred multicolor toner image to be fixed onto the sheet P with heat and pressure.

Here, the heating unit side temperature sensor 36 measures the surface temperature of the heating roller 30, appropriately conducts temperature control in accordance with the measured signal, and controls a current value, etc., or causes a current to flow in the heater 34 or blocks the heater 34. The temperature of the heating roller 30 is not particularly limited, so that it may be selected in accordance with the type of image forming apparatus or the type of toner; for example, it may be set to around 100° C.-180° C., and generally may be set to around 160° C. Moreover, the pressurizing unit side temperature sensor 39 is provided also on the pressurizing roller 37 side, so that it may be configured to make it possible to measure the surface temperature of the pressurizing roller 37.

The type of the pressurizing unit side temperature sensor 39 and the heating unit side temperature sensor 36 that are provided in the pressurizing unit and the heating unit is not particularly limited, so that it may be selected in alignment with the temperature range measured. For example, similarly to the temperature/humidity sensor 41, a thermistor, a band gap-type temperature sensor, etc., may be used. Moreover, the output values from the heating unit side temperature sensor 36 and the pressurizing unit side temperature sensor 39 may be used in calculating the curl amount as described below, making it possible to provide a configuration connecting to the CPU 46, for example, as shown in FIG. 3.

The fixed sheet P is guided with an outlet guide 70 to be guided to the curl straightening apparatus 40. The curl-straightened sheet P passes through the conveying path, and conveyed with the intermediate roller 61 and the sheet-discharging roller 62 to be discharged onto the sheet-discharging tray 50 from the sheet-discharging outlet 63.

The image forming apparatus 1 illustrated in FIG. 3 is configured to be provided with a CPU 46, such that the CPU 46 is connected with sensors, etc., provided in the image forming apparatus; and that, based on an output of the respective sensors, control information is output to a control apparatus 47, and a curl straightening apparatus 40 is controlled.

More specifically, as illustrated in FIG. 3, for example, the CPU 46 may be configured to be connected to the heating unit side temperature sensor 36 and the pressurizing unit side temperature sensor 39; the temperature/humidity sensor 41 on the sheet conveying path; and a sheet thickness detecting sensor 406. Then, the CPU 46 may be configured to obtain output values for temperature, humidity, and sheet thickness, which are output from these sensors. A method of calculating a final curl amount (projected curl amount) will be described below.

Then, the CPU 46 calculates the control value of the curl straightening apparatus and the final curl amount based on output values, etc., of these sensors, and outputs the results thereof to the control apparatus 47. Then, the control apparatus 47 may control an operation of the curl straightening apparatus 40 using a control value of the curl straightening apparatus from the CPU 46.

Figure 4:
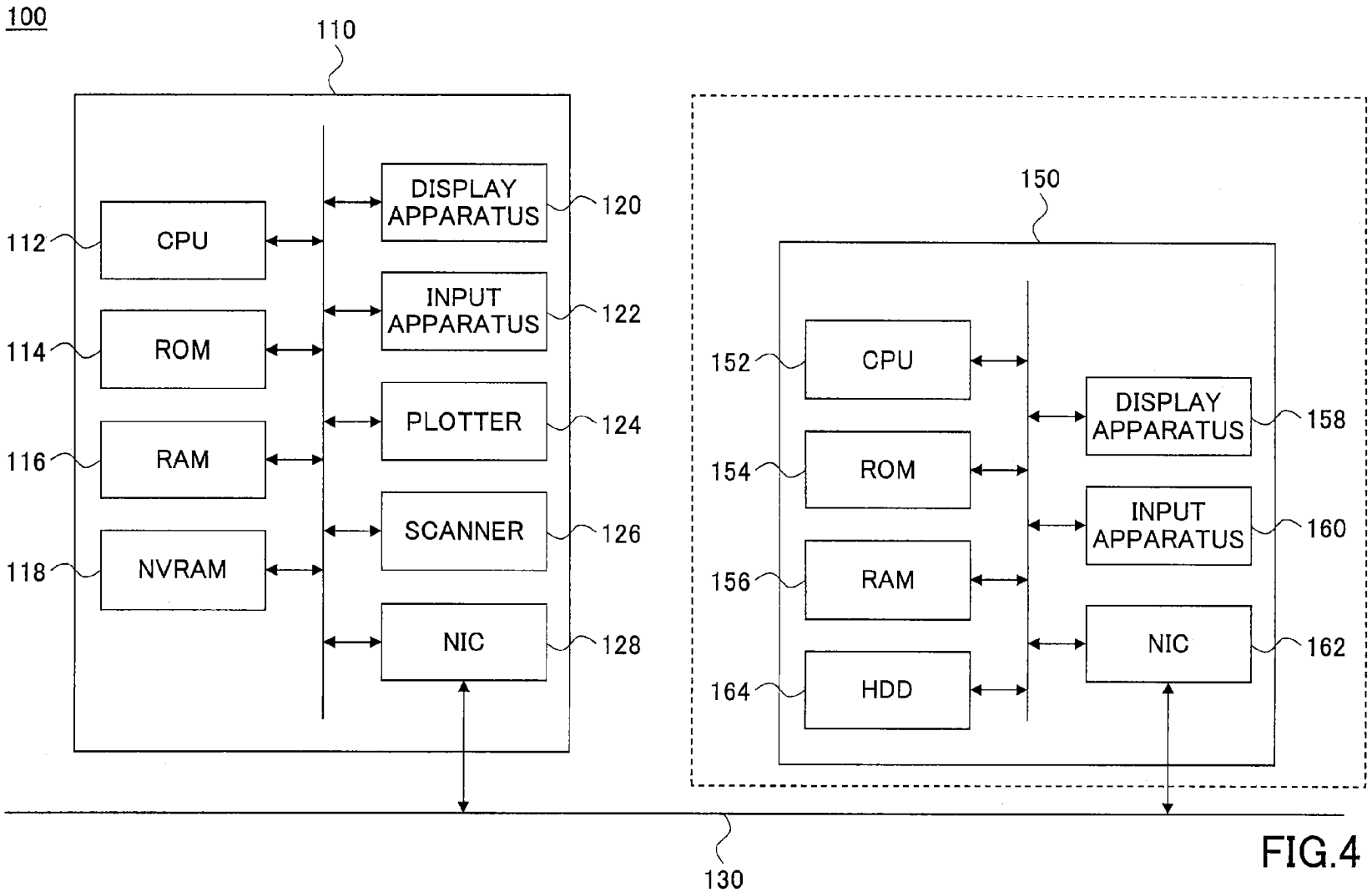
FIG. 4 is an explanatory diagram of an exemplary hardware configuration of an image forming system including the image forming apparatus according to the embodiment of the present invention.

The configuration of the curl straightening apparatus 40 is not particularly limited, so that it may be what can straighten the curl of the sheet P conveyed in response to the output from the control apparatus 47. For example, as shown in FIG. 3, it may be configured to include an endless belt 45 which is stretched between two rollers 451 and 452 which make up the conveying path of the sheet P; a conveying drive roller 42 which opposes and abuts against a stretched face of the endless belt 45 and rotates in a direction corresponding to a conveying direction of the sheet; a spring 43; and a cam 44. Then, in a curl straightening apparatus 40 which has the respective configuration, a curl which is produced in a sheet is straightened, so that, under the control of the control apparatus 47, the cam 44 is driven, a force is applied by the spring 43, and a winding angle of the conveying drive roller 42 of the endless belt 45 is caused to be changeable. In this way, curl straightening in accordance with a final curl amount (projected curl amount) may be applied to the sheet P. Next, an exemplary hardware configuration of an image forming system which is configured to include an image forming apparatus 1 according to the present embodiment is described. FIG. 4 is a hardware configuration 100 of an image forming system including an image forming apparatus according to the present embodiment.

As shown in FIG. 4, the image forming apparatus 110 according to the present embodiment includes a CPU 112 which controls the operation of the curl straightening apparatus 40, the image forming operations such as image forming, sheet conveying, etc. Moreover, it includes a ROM (Read-Only Memory) 114 which stores a BIOS (basic input/output system); and a RAM (Random Access Memory) 116 which provides an execution space of the CPU 112. Moreover, it may include a NV-RAM (Non Volatile-RAM) 118. The NV-RAM 118 stores control value calculating data, etc., for adjusting the curl straightening apparatus 40 in accordance with the final curl amount (projected curl amount), curl calculating data for calculating the below-described final curl amount (projected curl amount) and system setting information.

The image forming apparatus 110 may be configured to include an input apparatus 122 and a display apparatus 120 such as an operation panel, etc.; a plotter 124 for carrying out the image forming operation; and a scanner 126 for carrying out the image reading operation. Moreover, it may also be configured to include a NIC (network interface card) 128 which causes the image forming apparatus 110 to be connected to the network 130.

The above-described configuration of the network 130 is not particularly limited. It may be configured as a WAN (Wide Area Network), etc., connected using a dedicated line, a VPN (virtual private network), a LAN (local area network) using a transaction protocol such as TCP/IP (transmission control protocol/internet protocol), the Ethernet (registered trademark), etc. Moreover, the network 130 may include the Internet, etc., which are connected via a router (not shown), or may be configured as a wired network, a wireless network, or a network combining these networks.

The network 130 may be configured to have a server apparatus 150 further connected thereto. The server apparatus 150 may collectively manage sheet stress relaxation characteristics data, sheet shrinkage rate data for calculating the final curl amount (projected curl amount) in accordance with the sheet type (including distinctions among various products supplied from each supplier). Moreover, a server function which transmits, as needed, updating data for curl calculating data may be provided in accordance with a request from the image forming apparatus.

The above-described configuration of the server apparatus 150 is not particularly limited. For example, it may be configured as a computer apparatus such as an image forming apparatus, etc., provided with a server function, a blade server, a workstation, a personal computer. For example, it may be configured to include an HDD 164; an NIC 162; an input apparatus 160 such as a mouse, a keyboard, etc., a display apparatus 158 such as a display apparatus, etc., a RAM 156, a ROM 154, and a CPU 152. This makes it possible to realize a server function which provides the above-described updating data for the curl calculating data.

Figure 5:
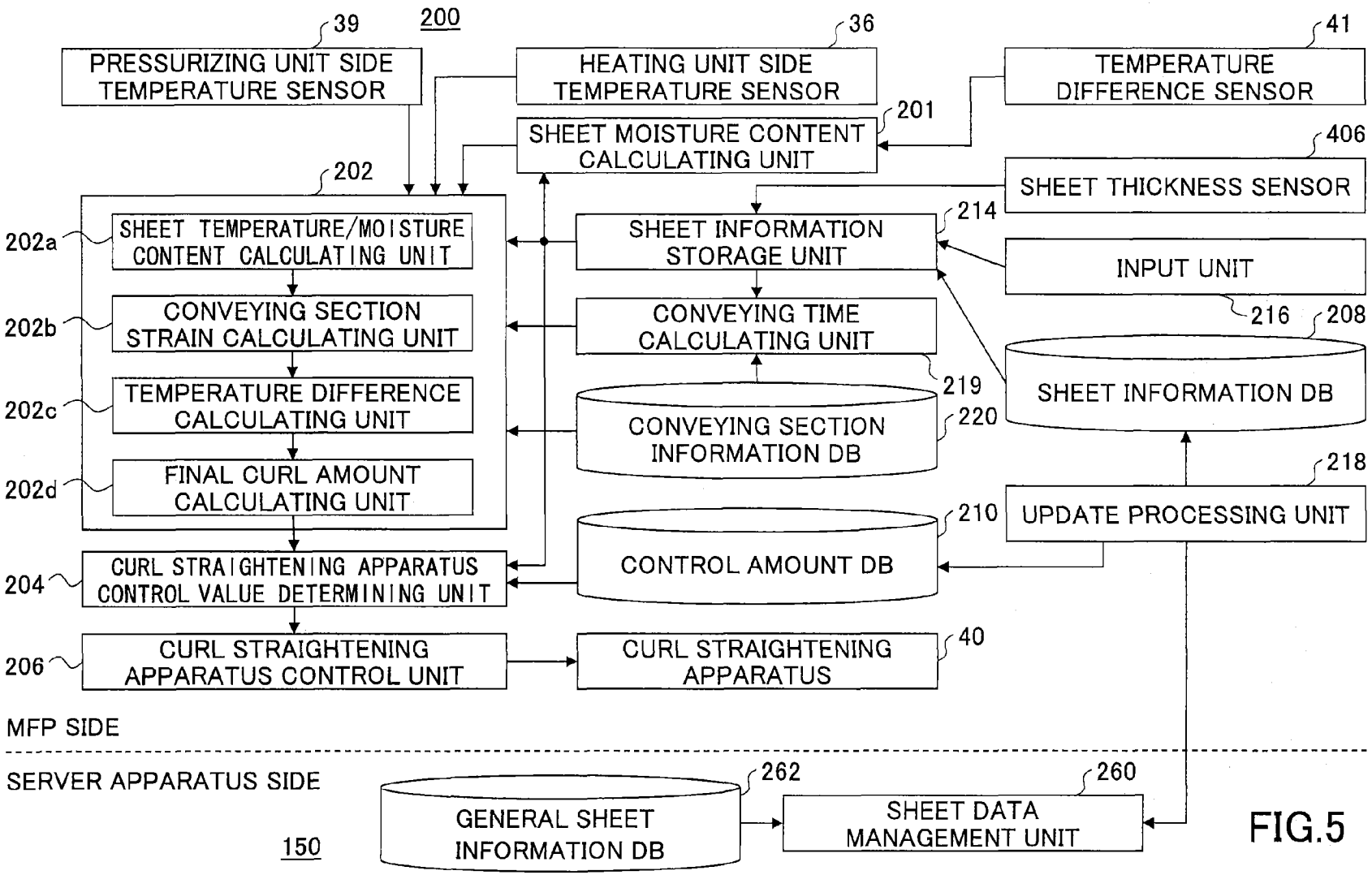
FIG. 5 is a functional block diagram of a server apparatus and the image forming apparatus according to the embodiment of the present invention.

FIG. 5 illustrates a functional block diagram of the server apparatus and the image forming apparatus according to the present embodiment. As illustrated in FIG. 5, a functional block 200 of the image forming apparatus is configured to include a curl amount projecting unit 202; a curl straightening apparatus control value determining unit 204; and a curl straightening control unit 206.

A sheet information storage unit 214 temporarily stores data on a sheet supplied to the image forming apparatus. A function may be realized by a storage unit such as the RAM 116, the NV-RAM 118, etc.

For example, the type of the sheet currently being set to the paper-supplying cassettes 51 and 52 that is input by an operator, etc., may be held in an appropriate storage area. Moreover, the sheet information storage unit 214 may hold a type identifying value which identifies the type of the sheet for each paper-supplying cassette. This type identifying value characterizes the sheet being set to the paper-supplying set. Then, a value to be specified as the type identifying value may include information on whether the sheet is a vertical mesh paper or a horizontal mesh paper; a category value indicating a category of the sheet, such as a mat paper, a glossy paper, a semi-glossy paper, a recycled paper, a high quality paper; and a value indicating that the type of the sheet is unknown. Here, when the longitudinal direction of fiber generally matches the sheet conveying direction, the sheet is referred to as a "vertical mesh sheet", whereas, when the longitudinal direction of fiber generally matches the sheet width direction, the sheet is referred to as a "horizontal mesh sheet". For example, curl due to the temperature difference is produced in the width direction of fiber, so whether the sheet is the vertical mesh sheet or the horizontal mesh sheet may be taken into account as a factor when calculating temperature difference strain, etc.

Moreover, when there is no sheet thickness detecting sensor 406, data held by the sheet information storage unit 214 also includes a thickness value which specifies a thickness of the sheet. Moreover, in the sheet information storage unit 214, data on the sheet supplied to the image forming apparatus, such as the sheet stress relaxation characteristics, etc., may be obtained from a sheet information DB 208 and stored therein. Here, the sheet information DB 208 includes information such as the stress relaxation characteristics, etc., for each of a vertical mesh sheet case and a horizontal mesh sheet case; the sheet information storage unit 214 may select and obtain data in accordance with whether the sheet to be supplied is the vertical mesh sheet or the horizontal mesh sheet. Then, data may be supplied as needed when calculating in the curl amount projecting unit 202, etc.

A conveying time calculating unit 219 obtains a section length and a curvature radius for the respective conveying sections from the conveying section information DB (database) 220; and determines a conveying time of the respective conveying sections from the sheet conveying speed which is determined from sheet information stored in the sheet information storage unit 214. The conveying time calculating unit 219 may realize the function by the CPU 112.

The conveying sections herein refer to divisions of a conveying path to a paper-discharging outlet 63 from the nip portion 35 of the fixing apparatus such that the curvature rate of the conveying path becomes constant in the respective conveying sections. The conveying section is described using FIG. 3. In FIG. 3, a section to the paper-discharging outlet 63 configured by the paper-discharging roller 62 from the nip portion 35 is divided into seven conveying sections such that the curvature rate within the respective sections is constant. The number of divisions is not particularly limited, so that it may be selected in accordance with the calculation capabilities, etc., of the curl amount projecting unit and the shape of the conveying path.

More specifically, the periphery of the nip portion 35 is a first conveying section with a constant curvature radius r1, where the length of the conveying path is L1. The periphery of the outlet guide 70 that follows is a conveying section with a curvature radius r2 and a length L2 (As the conveying section is a straight line, a large value which corresponds to infinity may be used for the curvature radius.) Moreover, an inlet portion of the curl straightening apparatus 40 is set to be a conveying section with a curvature radius r3 and a length L3. Then, conveying sections are successively divided thereafter as the curvature rate changes to from r4 to r7, up to the paper-discharging outlet 63, where the lengths of the respective conveying sections are L4-L7. For convenience of descriptions, while the length of the conveying section is represented as the length in the horizontal direction shown, the section length of the respective conveying sections is the length of an arc portion of the conveying path.

The sheet moisture content calculating unit 201 obtains data in which the moisture content of the sheet before pressurizing and heating in the fixing apparatus is measured by the temperature/humidity sensor 41, and determines the moisture content of the sheet before being supplied to the fixing apparatus in accordance with a table or a function which calculates the moisture content of the sheet. The sheet moisture content calculating unit 201 may realize the function by the CPU 112.

The curl amount projecting unit 202 may be configured to include a sheet temperature/moisture content calculating unit 202*a*; a conveying section strain calculating unit 202*b*; a temperature difference strain calculating unit 202*c*; and a final curl amount calculating unit 202*d*. It may be configured to arbitrarily provide or not provide the temperature difference strain calculating unit 202*c*. Moreover, the functions of the respective calculating units may be realized by the CPU 112. The sheet temperature/moisture content calculating unit 202*a* calculates the temperature and the moisture content of the sheet in the respective conveying sections. As a specific procedure, first, the temperature and the moisture content of the sheet prior to undergoing the process in the fixing apparatus that are obtained and calculated in the sheet moisture content calculating unit 201; and output values from the pressurizing unit side temperature sensor 39 and the heating unit side temperature sensor 36 are obtained. Moreover, the conveying time of the respective conveying sections is obtained by the conveying time calculating unit 219. The temperature and the moisture content of the sheet in the respective conveying sections may be calculated using a table or from the obtained data.

A conveying section strain calculating unit 202*b* calculates a conveying section strain using the stress relaxation characteristics of the sheet and the temperature, moisture content, and the conveying time of the sheet in the respective conveying sections for the respective conveying sections from the nip portion 35 to the paper-discharging outlet 63. Data calculated by the sheet temperature/moisture content calculating unit may be obtained and used for the temperature and moisture content of the sheet in the respective conveying sections. Moreover, in carrying out the calculations, data on stress relaxation characteristics of the sheet may be obtained from the sheet information storage unit 214; the curvature radius of the respective conveying sections may be obtained from the conveying section information DB 220, and the conveying time of the respective conveying sections may be obtained from the conveying time calculating unit 219. Proper use may be made of the stress relaxation characteristics depending on whether the sheet is a vertical mesh sheet or a horizontal mesh sheet with respect to the conveying direction.

The temperature difference strain calculating unit 202*c* calculates the temperature difference strain caused by the temperature difference between the front side and the back side of the sheet in the nip portion 35. As described above, the present calculating unit is a calculating unit which may be provided arbitrarily, so that it may be configured not to provide the present calculating unit, for example, when the curl straightening apparatus 40 only handles the curl in the conveying direction and does not handle the curl in the width direction.

When the temperature difference strain calculating unit 202*c* is provided, in the below-described final curl calculating unit, the final curl amount is calculated using the temperature difference strain; and residual strain of the sheet in the respective conveying sections.

Then, the temperature difference strain calculating unit 202*c* may be configured to include the respective calculating units below.

A sheet-internal temperature distribution calculating unit which calculates the temperature distribution in the thickness direction of the sheet after passing through the nip portion; a moisture content distribution calculating unit which calculates a moisture content distribution in the thickness direction of the sheet after passing through the nip portion; and a temperature difference strain calculating unit which, based on the moisture content distribution and the temperature distribution in the thickness direction of the sheet which passed through the nip portion that is calculated by the sheet-internal temperature distribution calculating unit and the moisture content distribution calculating unit, calculates the shrinkage rate of the front face and the back face of the sheet, and calculates the strain difference of the front and the back of the sheet from the shrinkage rate of the front face and the back face of the sheet.

The final curl amount calculating unit 202*d* may calculate the final curl amount using the residual strain of the sheet in the respective conveying sections that is calculated by the conveying section strain calculating unit.

More specifically, first, the conveying section strains of the respective conveying sections calculated by the conveying section strain calculating unit 202*b* are added. When the temperature difference strain calculating unit 202*c* is provided, the final curl amount calculating unit 202*d* adds the temperature difference strain calculated by the temperature difference strain calculating unit 202*c* and the conveying section of the respective conveying sections that are calculated by the conveying section strain calculating unit 202*b*.

Then, the curl amount formed to the paper-discharging outlet 63 from the nip portion 35 of the fixing apparatus, or, in other words, the final curl amount (projected curl amount) is calculated based on a value in which the residual strains of the sheet in the respective conveying sections, and, possibly, the temperature difference strains are added.

In accordance with the final curl amount calculated by the final curl amount calculating unit 202, the curl straightening apparatus control value determining unit 204 determines the control value of the curl straightening apparatus such that the curl amount of the sheet at the paper-discharging outlet 63 becomes 0.

As illustrated in FIG. 5, the functional block 200 of the image forming apparatus includes a control amount DB 210 which holds a control value calculating table which collates the above-described control value and the final curl amount. Here, the control value calculating table is for defining a straightening control value which is necessary for carrying out curl straightening of a desired curl amount in the curl straightening apparatus. Then, the curl straightening apparatus control value determining unit 204 may refer to the control value calculating table stored in the control amount DB 210, conducts a search using a final curl amount calculated by the final curl amount calculating unit, and determines the control value of the corresponding curl straightening apparatus. The control amount DB 210 may realize its functionality using various storage units and may realize its functionality using the ROM 114 and the NVRAM 118.

Moreover, the control value of the curl straightening apparatus may also be calculated using a predetermined function without using control value calculating data of the table structure.

There may be differences in the curl amount in accordance with whether the sheet is a vertical mesh sheet or a horizontal mesh sheet and, moreover, in accordance with whether the heating roller 30 side is the front face or the back face of the sheet depending on the type of the sheet. Therefore, after the final curl amount calculated by the final curl amount calculating unit 202*d* is corrected by the final curl amount calculating unit 202*d* or the curl straightening apparatus control value determining unit 204, the control value may also be selected by the curl straightening apparatus control value determining unit 204.

Then, the curl straightening control unit 206 controls the curl straightening apparatus 40 such that curl straightening is performed in accordance with the control value determined by the curl straightening apparatus control value determining unit 204.

The function block 200 of the image forming apparatus according to the present embodiment may further include an update processing unit 218. The update processing unit 218 performs an update process of data stored in the control amount DB 210 and the sheet information DB 208 so as to respond to changes such as specifications changes and releases of new products of sheets distributed in the market. Information contents to be updated includes, for example, a function or a table of the shrinkage rate relative to the moisture content, the temperature, the thickness, the paper type; a table of the stress relaxation characteristics; a table of the straightening control value; a relationship equation or a table, etc., of the temperature/humidity and the moisture content near the paper surface.

The updating process may be configured such that a general sheet information DB 262 is accessed via the server apparatus side sheet data management unit 260 which is connected via the network and necessary data are downloaded.

Timing at which data within the control amount DB 210 and the sheet information DB 208 are updated is not particularly limited, so that the updating may be performed at arbitrary timing. For example, it may be performed when setting of the sheet information storage unit 214 is changed from the input unit 216 and it is detected that there are no curl calculating data which correspond to the type identifying value. Moreover, the updating process may be started at timing that there was an instruction from an operator or at timing that scheduling was performed regardless of presence/absence of setting changes. As the characteristics of the product itself to be distributed could have changed with time elapsing, in order to respond to such changes, it is preferably configured such that an effective time limit for data, etc., of the straightening control value and the curl calculating data to be updated is set, so that they are periodically updated to the most recent data.

In the present updating process, the update processing unit 218 transmits information on necessary data and a model identifying value of the present image forming apparatus to the sheet data management unit 260 on the server apparatus 150 side. In response to the received model identifying value, the sheet data management unit 260 on the server apparatus 150 side accesses the general sheet information DB 262, which is formed as a database, for each paper type distributed in the market. Then, the corresponding data are obtained and updating data are transmitted to the update processing unit 218 on the image forming apparatus side. The update processing unit 218 obtains the updating data to update data such as the sheet information DB 208, etc.

Next, a method of calculating the curl amount is described.

First, the conveying path to the paper-discharging outlet 63 from the nip portion 35 of the fixing apparatus is divided into multiple conveying sections such that the curvature of the conveying path becomes constant in the respective conveying sections. In the exemplary configuration shown in FIG. 3, it is divided into seven conveying sections as described above. Assuming a section length of the conveying section as Ln and a conveying speed of the sheet as Vp, a conveying time to of the conveying section is represented by the following mathematical equation (1), where n is the number specifying the conveying section, so that n is 1 for the nip portion 35 in FIG. 3.

$$tn = \frac{\mathrm{Ln}}{Vp} \tag{1}$$

Then, assuming a sheet thickness as tp and a curvature radius of the conveying section as rn, a sheet strain $\in_{in}$ due to bending is represented by the following mathematical equation (2):

$$\in_{in}=(tp/2)/rn \tag{2}$$

Figure 6:
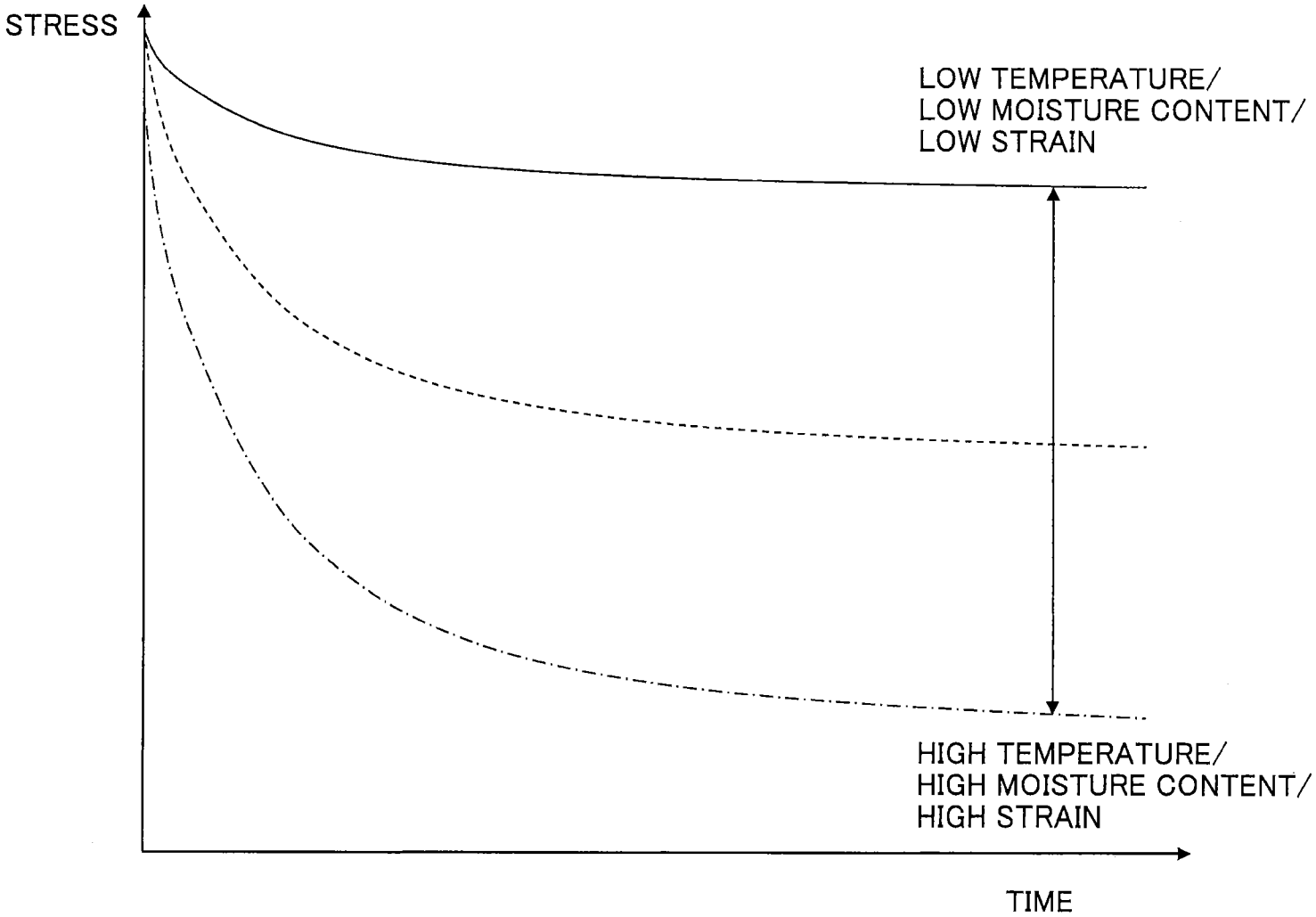
FIG. 6 is an explanatory diagram illustrating stress relaxation characteristics of a sheet according to the embodiment of the present invention.

Here, FIG. 6 illustrates the stress relaxation characteristics of the sheet, with the horizontal axis representing time and the vertical axis representing stress. Although stress is produced when certain strain existing in the sheet is applied, the paper is a viscoelastic body, causing stress relaxation in which stress decreases as shown in FIG. 6. For the sheet, the higher the temperature, the higher the moisture content, and the larger the strain, the higher the stress relaxation, whereas the lower the temperature, the lower the moisture content, and the smaller the strain, the lower the stress relaxation. The stress relaxation refers to residue strain being produced due to plastic deformation, so that curl in the conveying path is produced due to this stress relaxation of the sheet. Such stress relaxation may be expressed as a generalized Maxwell model shown in the following mathematical equation (3), assuming the stress of the sheet as SR. In the equation, Sz is stress after unlimited time, whereas τ is a time constant.

$$SR(t) = Sz + \sum_{i}^{N} S_i \cdot \exp\left(-\frac{t}{\tau_i}\right) \tag{3}$$

The respective constants, which change due to stress applied, moisture contents, and the temperature of the sheet, are represented as in the following mathematical equation (4), assuming the time as t, the temperature as T, the moisture content as M, and the strain as ∈.

$$SR(t, T, M, \varepsilon) = Sz(T, M, \varepsilon) + \sum_{i}^{N} S_i(T, M, \varepsilon) \cdot \exp\left(-\frac{t}{\tau_i(T, M, \varepsilon)}\right) \tag{4}$$

Assuming the thickness of the sheet as tp and the Young's modulus as Ep, an initial stress SR (0, T, M, ∈) which is received by the sheet in the conveying section is expressed by the following equation. As the Young's modulus also changes due to the temperature or the humidity of the paper, the temperature T, the moisture content M, and the strain may be represented by the following mathematical equation (5).

$$SR(0, T, M, \varepsilon) = \frac{tp}{2 \cdot r} Ep(T, M, \varepsilon) \tag{5}$$

For values of Sz(T, M, ∈); Si(T, M, ∈), and τ(T. M, ∈) in the mathematical equation (4), data are obtained for a number of temperatures T, moisture content M, and strain ∈ for representative paper types. Then, it is preferable to determine a table or a function on the temperature T, the humidity M, and the strain ∈ from the respective data sets. Moreover, also for the Young's modulus Ep, it is preferable to obtain data on the temperature T, the humidity M, and the strain ∈ for the representative paper types and determine the table or the function.

FIG. 7 shows a stress relaxation characteristics table as one example. With respect to the table shown in FIG. 7, which is for a case related to a specific strain ∈, a number of tables are separately held in correspondence with different strains. Alternatively, it may also be configured to use results of multiplying a coefficient in accordance with strain to a value obtained from a table to be a reference. In this table is configured a matrix using a temperature T, paper moisture content M, and a code I indicating the paper type and is included respectively corresponding constants. Assuming i in the mathematical equation (4) as a 4-th order, it may be sufficiently aligned to an experimental value. Therefore, Si ranges from S1 to S4, while τi ranges from τ1 to τ4. There is no problem to set S1 to S4 to be the same value, so that they are set as the same value, while τ1 to τ4 are different values. For brevity, τ1 to τ4 may be changed only by the type of paper, so that a constant value may be used for the temperature and the moisture content. This stress relaxation table may be experimentally determined using a paper pull test by changing the paper type, the paper moisture content M, and the temperature T. Here also, the paper type I is categorized into high quality paper, recycled paper, semi-glossy paper, glossy paper, mat paper, etc. Moreover, the characteristics may vary depending on whether the paper is a vertical mesh sheet or a horizontal mesh sheet, so that proper use may be made thereof in calculating strain of the conveying section.

A method of determining a curl amount from these stress relaxation characteristics is shown in the following.

The stress relaxation rate relative to bending stress of the sheet in a conveying section as Rsn may be expressed in mathematical equation (6), assuming the conveying time of the conveying section of tn, the sheet temperature of Tn, and the sheet moisture content of Mn:

$$Rsn(t_n, T_n, M_n, \in_{bn})=1-SR(t_n, T_n, M_n, \in_{bn})/SR(0, T_n, M_n, \in_{bn}) \tag{6}$$

The sheet strain $\in_{bn}$ which is received in the section is a sum of the strain $\in_{in}$ due to bending in accordance with the curvature radius of the section; and a residual strain $\in_{n-1}$ of the previous section and is expressed as in the following mathematical equation (7).

When the bending directions are the same, the strains are subjected to subtracting; on the other hand, when they are opposite, they are subjected to adding.

$$\in_{bn}=\in_{n-1}+\in_{in} \tag{7}$$

The strain $\in_n$ after leaving this conveying section is shown by the following equation:

$$\in_n=Rsn(t_n, T_n, M_n, \in_{bn}) \cdot \in_{bn}+\in_{n-1} \tag{8}$$

This calculation is carried out to the paper-discharging outlet 63 from the nip portion 35 of the fixing apparatus (for seven conveying sections for an example of the image forming apparatus shown in FIG. 2) and a final strain $\in_{end}$ is determined, and a curl amount R is determined therefrom by the following equation:

$$R=\in_{end}/(tp/2) \tag{9}$$

Next, a method of calculating a temperature difference strain is described.

When there is a temperature difference between the heating unit and the pressurizing unit of the fixing apparatus, or, in other words, for a configuration in FIG. 2, when there is the temperature difference between the heating roller 30 and the pressurizing roller 37, a curl toward the low temperature side is produced in the sheet which passed through the above-described fixing apparatus.

This point is described using FIGS. 8A to 8D.

Figure 8A:
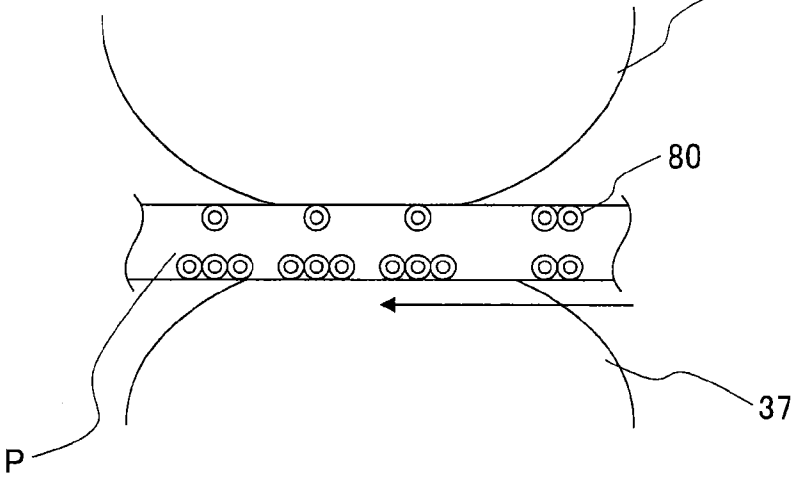
FIGS. 8A to 8D are explanatory diagrams of a curl generating mechanism due to a temperature difference between a heating unit and a pressurizing unit.
Figure 8B:
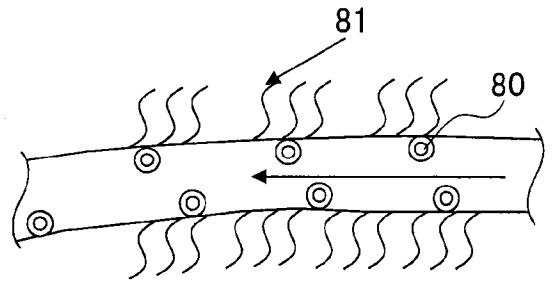

In FIG. 8A, when the sheet P proceeds, in the arrow direction shown, in a nip portion formed by the heating roller 30, which is a heating unit; and the pressurizing roller 37, which is a pressurizing unit, water vapor pressure on the heating roller 30 side increases. Therefore, the moisture 80, schematically shown with a double circle, that is included in an air gap between fibers, and fibers of the sheet moves to the pressurizing roller side with the pressure. As a result, the moisture content on the pressuring roller 37 with the temperature lower than that of the heating roller 30 side becomes higher. As shown in FIG. 8B, which shows the state of the sheet P after being discharged from the nip portion of the fixing apparatus, much moisture evaporates as gas (water vapor) 81 from the pressurizing roller side, which has high moisture content.

Figure 8C:
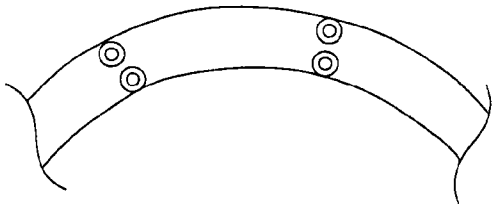
Figure 8D:
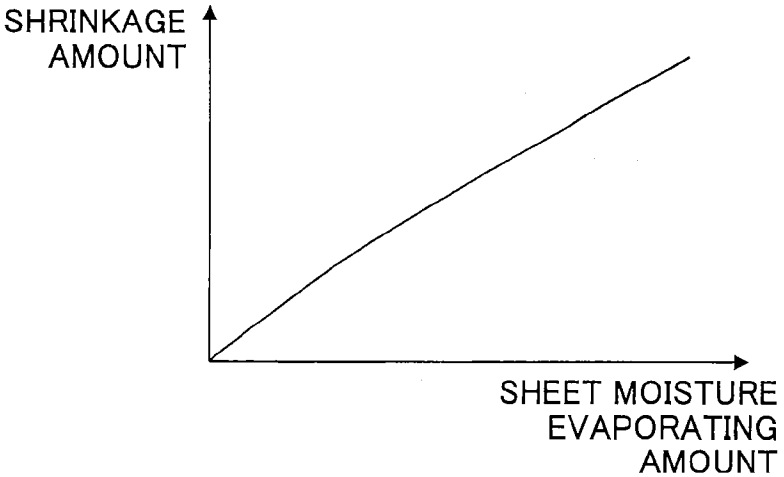

As shown in FIG. 8D, the shrinking amount is almost proportional to the moisture amount evaporating from the sheet P here. Thus, of the sheet P, the pressurizing roller side from which much moisture has evaporated shrinks more than the heating roller side, so that curl is produced on the pressurizing roller side as shown in FIG. 8C.

When a hygrometer is installed near the front and the back of the sheet immediately after a fixing nip, curl is found with the inside thereof being the side in which the humidity is high, or in other words, on the side with a large evaporating amount; and it was found that the larger the difference in humidity the larger the curl. In this way, when there is a large temperature difference between the heating unit and the pressurizing unit, a disparity in the moisture content increases due to internal moisture movement, increasing the curl amount.

Figure 9:
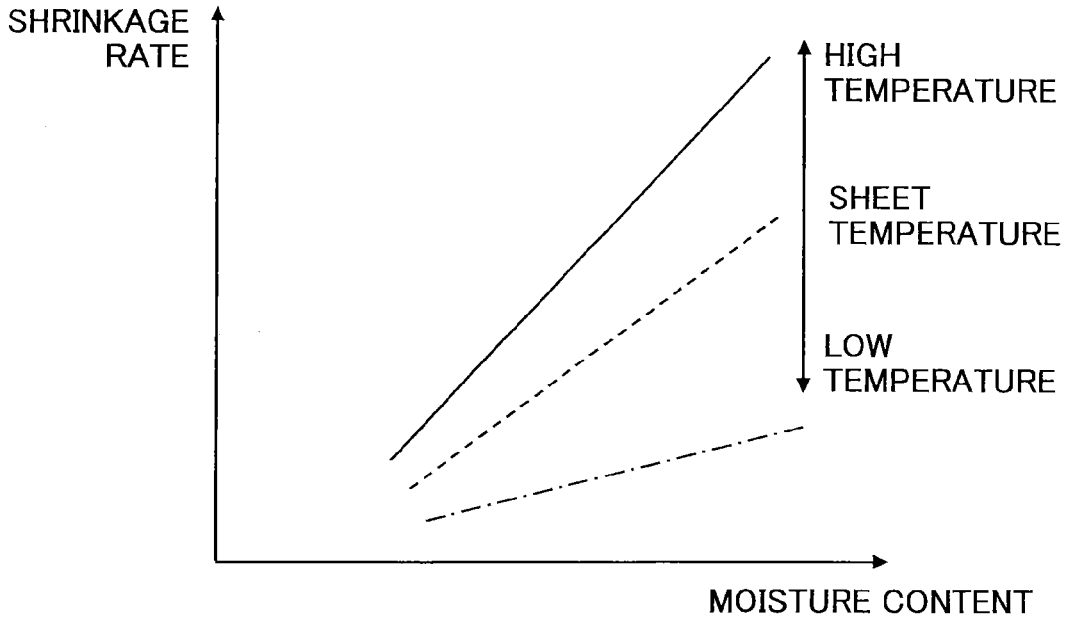
FIG. 9 is an explanatory diagram of a relationship between moisture content and a shrinkage rate of a sheet according to the embodiment of the present invention.

FIG. 9 shows a relationship between the shrinkage rate and the moisture content of the sheet that are determined experimentally. The shrinkage rate increases in proportion to the moisture content and also the higher the temperature the higher the shrinkage rate. The higher the moisture content and the higher the temperature, the larger the evaporating amount. Therefore, if the temperature distribution and the moisture content distribution in the thickness direction of the sheet are known, the shrinkage rate distribution in the thickness direction becomes known, so that the curl due to the temperature difference may be projected.

The distribution of the moisture content and the temperature of the sheet can be determined by calculation using a nip time determined from the sheet conveying speed and the nip width of the pressurizing roller and the heating roller; the temperature of the pressurizing roller and the heating roller; the moisture content before heating; and physical properties corresponding to the type of the sheet. Moreover, the curl amount can be determined using a bimetallic model from the shrinkage rate and the thickness of the sheet.

On the other hand, the direction in which the curl is formed generally changes with an arrangement of fibers within the sheet. As described above, the sheet is set to be a vertical mesh when the conveying direction of the sheet generally matches the longitudinal direction of the fibers, while the sheet is set to be a horizontal mesh when the longitudinal direction of the fibers generally matches the width direction (the direction orthogonal to the conveying direction) of the sheet. The curl due to the temperature difference is produced in the width direction of the fibers, so that the vertical mesh sheet curls in the width direction and the horizontal mesh sheet curls along the conveying direction. Therefore, as described above, when the curl straightening apparatus 40 handles only the curl in the conveying direction and does not handle the curl in the width direction, it may be configured not to calculate the temperature difference strain.

As described above, the temperature difference strain is produced when the heating temperature difference causes moisture to move toward the low temperature side in the paper thickness direction, causing a difference in moisture content between the front and the back of the sheet, which leads to a difference in the evaporating amount and a difference in the shrinkage rate of the sheet. Therefore, the strain due to this temperature difference is determined by dividing, into two, the sheet in the thickness direction between the high temperature side and the low temperature side.

Figure 10:
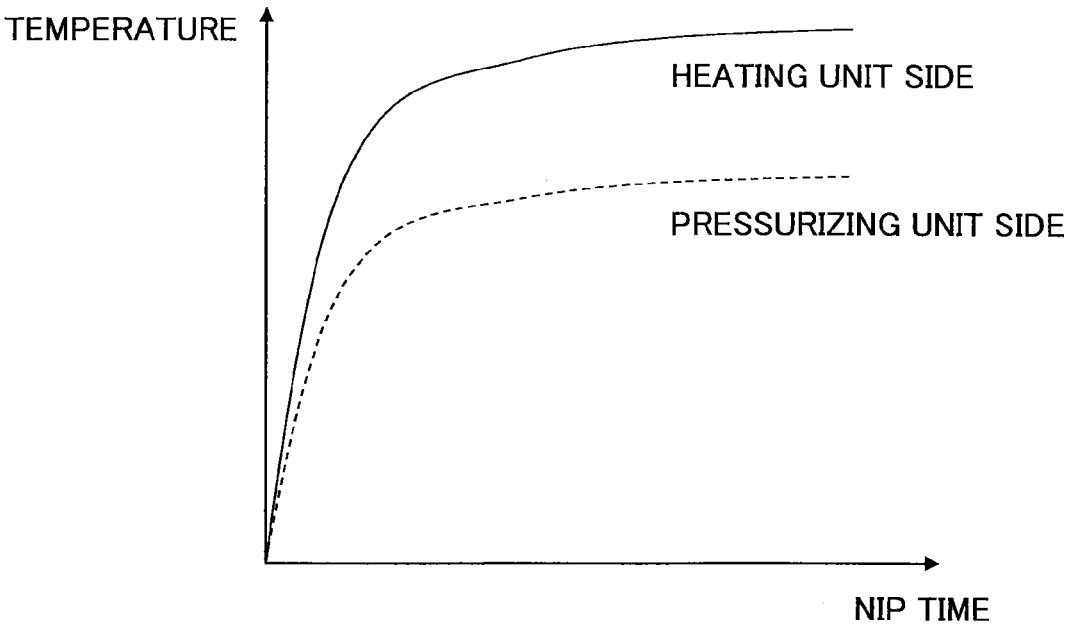
FIG. 10 is an explanatory diagram of a relationship between a nip time and a temperature within the sheet according to the embodiment of the present invention.
Figure 11:
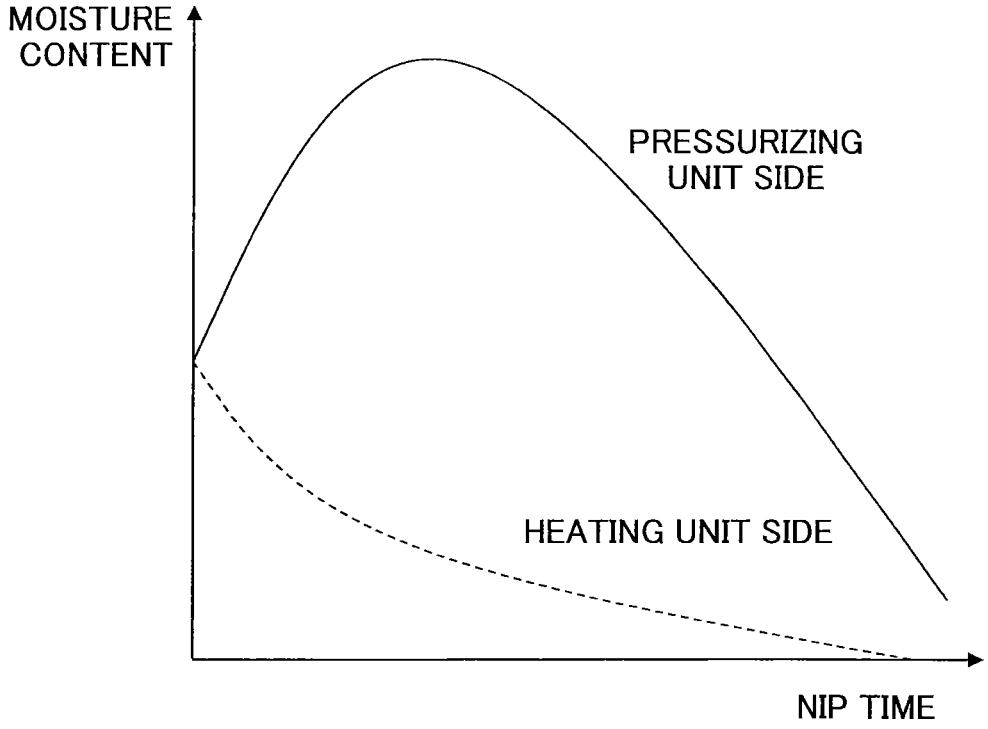
FIG. 11 is an explanatory diagram of a relationship between a nip time and the moisture content within the sheet according to the embodiment of the present invention.

FIGS. 10 and 11 illustrate an example of changes in the temperature and the moisture content on the high temperature side and the low temperature side when the front and the back of the sheet are heated with a temperature difference therebetween. FIG. 10 shows an average temperature of the high temperature side and the low temperature side of the sheet, with the horizontal axis being the nip time and the vertical axis being the temperature (average temperature). A temperature difference between the heating unit side and the pressurizing unit side causes differences among average temperatures of the respective layers within the paper as shown in FIG. 10.

FIG. 11 shows a change in the average moisture content on the high temperature side and the low temperature side of the sheet, with the horizontal axis being the heating time and the vertical axis being the moisture content (average moisture content). On the heating roller side with a high temperature, the moisture content decreases immediately after the nip start and approaches 0. This is because the water vapor pressure rises due to a temperature increase, thereby causing moisture to be pushed out to the low temperature side and, moreover, because moisture evaporates as the boiling point is exceeded. On the pressurizing unit side with a low temperature, moisture content rises due to moisture movement from the heating fixing side after the nip start; however, thereafter moisture evaporates due to a temperature increase, so that the moisture content decreases.

The shrinkage rate of the sheet may be determined experimentally. FIG. 9 shows the results thereof, with the horizontal axis showing the moisture content of the sheet (before it is introduced into the fixing apparatus) and the vertical axis showing the shrinkage rate. The shrinkage rate increases in proportion to the moisture content and also the higher the temperature the higher the shrinkage rate.

Figure 12A:
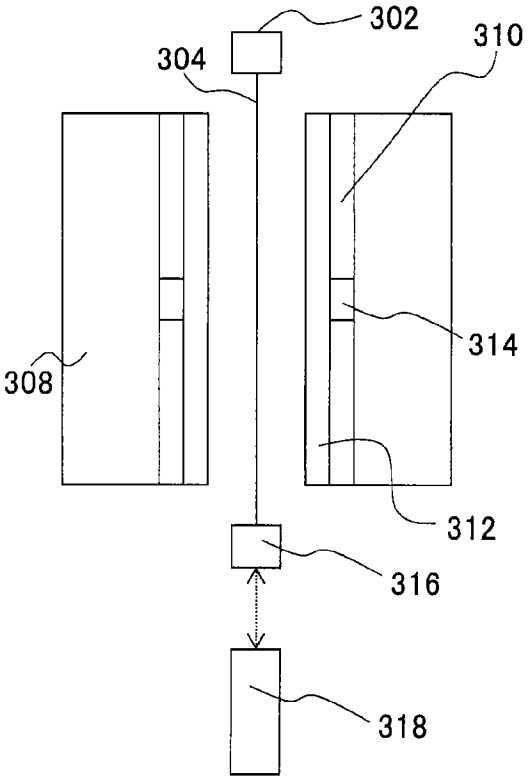
FIGS. 12A to 12C are explanatory diagrams of an exemplary configuration of an experimental apparatus which determines the relationship between the moisture content and the shrinkage rate of the sheet.
Figure 12B:
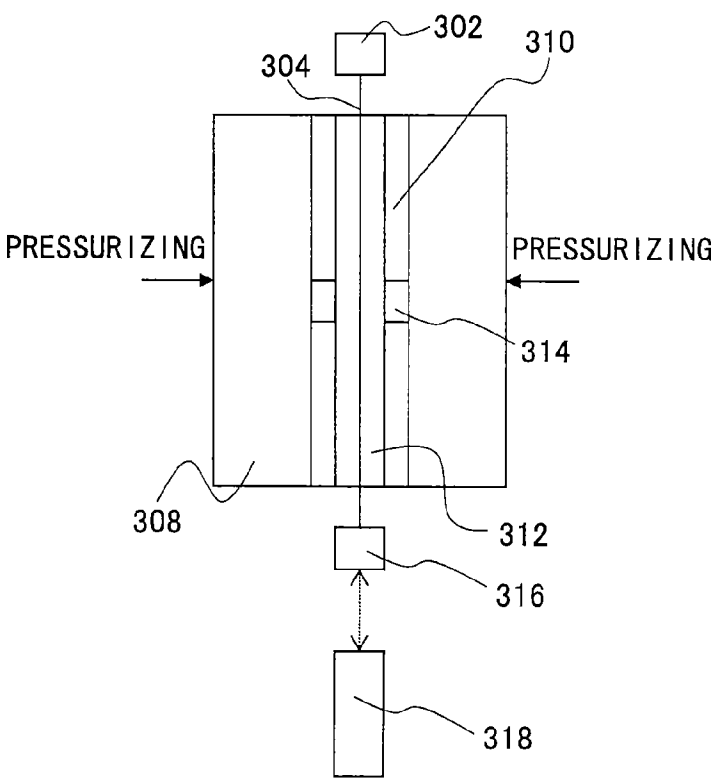
Figure 12C:
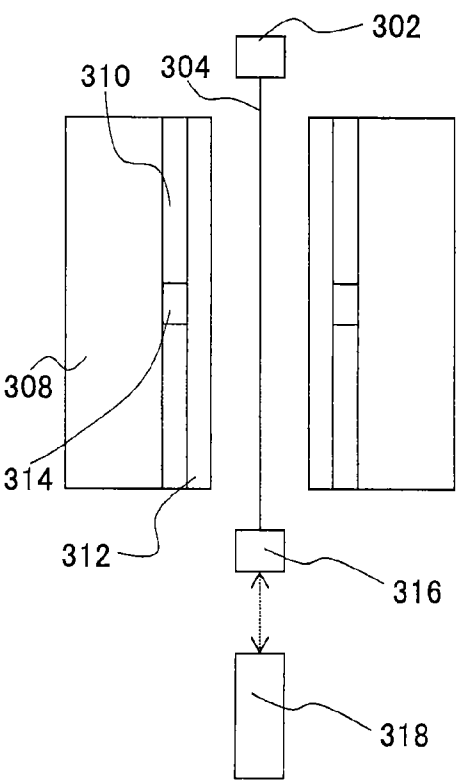

Here, experimental results shown in FIG. 9 may be measured using an experimental apparatus 300 shown in FIGS. 12A to 12C, for example. In the experimental apparatus 300 shown in FIG. 12A, first a sheet sample 304 to be measured is held to a sample holder 302 to be suspended vertically downward. On both sides of the sheet sample 304, a plate 308 which is heated to a predetermined temperature is installed such that it can be moved in the horizontal direction shown. On a surface of the plate 308 is pasted a heating heater 310, on which surface a rubber 312 is pasted, and, moreover, temperature measurement near the heating surface is made possible by a temperature sensor 314. It is also possible to conduct the control of temperature to a predetermined temperature in a temperature control unit (not shown). At the lower end of the paper sample 304 is installed a weight 316 of around several tens of grams, and a distance sensor 318 which can measure a position of a lower face of the weight. The distance sensor 318 is desirably a non-contact type using laser light, and is desirably one having a resolution of no more than 1 μm.

As shown in FIG. 12B, in the operation of this testing equipment unit, first the sheet sample 304 is pressurized and heated from left and right with the plate 308 for a predetermined time with a predetermined pressurizing force. Thereafter, after a predetermined time has elapsed, as shown in FIG. 12C, the plate 308 is separated from the sheet sample 304. Then, the position (height) at the lower end of the weight is measured for approximately 30 seconds by the distance sensor 318. Here, the left and right plate temperatures are set to be the same temperature, which temperature is used as the temperature of the sheet. Assuming a displacement of the weight after a predetermined time as h and an initial length of the paper sample 304 as L, the shrinkage rate Sr may be calculated by the mathematical equation (10).

$$Sr = \frac{h}{L} \tag{10}$$

Such data may be obtained with various papers, stored in the sheet information DB 208 shown in FIG. 5, and read into the sheet information storage unit 214 in advance during operation. Of data to be stored in such a database, for the paper type, one type of paper may be used as representing the respective rough categories as high quality paper, recycled paper, coated paper, etc. The temperature of the sheet may also be measured in units of 20 degrees, for example, so that the shrinkage rate at the sheet temperature therebetween may be used by linear interpolation. Moreover, the shrinkage rate in the width direction may be measured for the vertical mesh sheet, while the shrinkage rate in the longitudinal direction may be measured for the longitudinal direction.

In this way, the strain $\in_t$ due to the temperature difference is determined. Assuming the shrinkage rate on the high temperature side as Sh and the shrinkage rate on the low temperature side as Sl, $\in_t$ is expressed by the following mathematical expression (11).

$$\in_t = Sl - Sh \tag{11}$$

The strain $\in_t$ due to the temperature difference, which is formed immediately following the nip portion 35 of the fixing apparatus, is added to the residual strain formed in the nip portion 35 as shown in mathematical equation (12). t is assumed that, in the nip portion 35, there is no residual strain in the previous conveying path and that the sheet strain $\in_{b1}$ received in the section is only a strain $\in_{i1}$ due to bending in accordance with the curvature radius of the section.

$$\in_1 = Rsn(t_1, T_1, M_1, \in_{i1}) \cdot \in_{i1} + \in_i \tag{12}$$

Next, a curl straightening operation of the curl straightening method according to the present embodiment is described. Moreover, the respective curl straightening operation may also be similarly executed in the image forming apparatus of the present embodiment.

Figure 13:
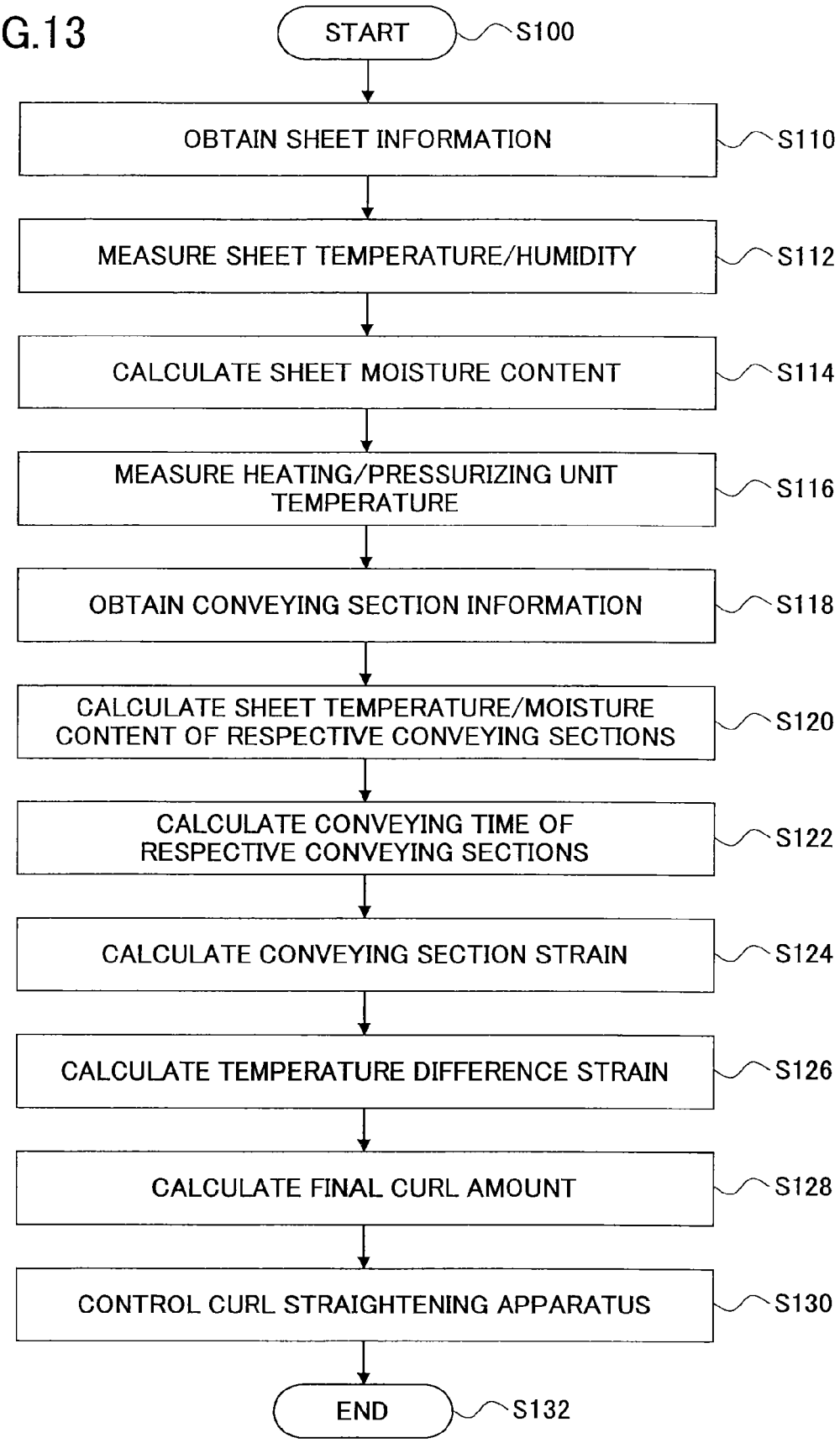
FIG. 13 is a flowchart of a curl straightening method according to the embodiment of the present invention.

FIG. 13 is a flowchart showing a curl straightening control operation which is executed in the curl straightening method according to the present embodiment. The operation shown in FIG. 13 is started from step S100 in alignment with appropriate timing in which the sheet passes through the temperature/humidity sensor 41 or the fixing apparatus and sets a straightening control value which is introduced before a tip of the sheet reaches the curl straightening apparatus 40.

In step S110, the CPU 112 reads sheet information stored in advance in the sheet information storage unit 214 and obtains a type identifying value to be specified for the paper-supplying cassette of the paper-supplying source of the present process.

In step S112, the CPU 112 obtains an output value from the temperature/humidity sensor 41.

In step S114, the CPU 112 determines the initial moisture content and the temperature of the sheet (before the sheet is supplied to the fixing apparatus) using the obtained type identifying value and the output value obtained in S112.

In step S116, the CPU 112 obtains temperature information of the heating roller 30 as the heating unit and the pressurizing roller 37 as the pressurizing unit from the respective heating unit side temperature sensor 36 and the pressurizing unit side temperature sensor 39.

In step S118, the CPU 112 obtains information on the curvature radius and the section length of the respective conveying sections from the conveying section information DB 220.

In step S120, the CPU 112 determines the moisture content and the temperature of the sheet in the respective conveying sections. In calculating, the initial temperature and moisture content of the sheet determined in step S114; temperature information on the pressurizing roller 37, which is a pressurizing unit, and the heating roller 30, which is a heating unit, that are obtained in S116; and the conveying speed of the sheet and the section length of the respective conveying sections that are obtained on S118 may be used.

In step S122, the CPU 112 calculates the conveying time of the sheet in the respective conveying sections.

In step S124, the CPU 112 determines the strain as described previously. In calculating, the temperature and the moisture content of the sheet in the respective conveying sections that are calculated in S120; the conveying time of the sheet in the respective conveying section that is calculated in S122; and stress relaxation characteristics of the sheet stored in the sheet information storage unit 214 may be used. Here, proper use may be made of the stress relaxation characteristics depending on whether the sheet is a vertical mesh or a horizontal mesh.

Step S126 is a temperature difference strain calculating step in which a temperature difference strain produced by a temperature difference between the front face and the back face of the sheet in the nip portion is calculated. The CPU 112 determines the temperature difference strain from the shrinkage rate of the sheet, the moisture content, and the temperature of the front and the back of the sheet in the nip portion 35. The temperature difference strain is produced in different directions due to fiber directions of the sheet, so that this step may be skipped when, as described above, the curl straightening apparatus 40 only handles a curl in the conveying direction and does not handle straightening the curl in the width direction. The temperature difference strain which is produced due to the temperature difference between the front face and the back face of the sheet is calculated in the nip portion.

In S128, which is a final curl amount calculating step, a final curl amount is calculated from a value in which residual strains of the sheet in the respective conveying sections are added. Moreover, when step S126 is carried out as in the above, a final curl amount is calculated from a value in which the temperature difference strain is further added to a value in which residual strains of the sheet in the respective conveying sections are added.

In step S130, the CPU 112 determines a control value of the curl straightening apparatus 40 and conducts control such that the final curl amount is negated. As described above, the control amount is determined using a table or a function stored in the control amount DB 210; and the final curl amount calculated in S128.

In step S132, a series of processes are completed; however, at the time of consecutive printing, it is desirable to conduct the above-described operations for each sheet.

Moreover, a case is described which includes a temperature difference strain calculating step S126 in which a temperature difference strain produced by a temperature difference between the front face and the back face of the sheet in the nip portion is calculated. In this case, in the final curl calculating step S128, the final curl amount is calculated using the temperature difference strain; and the residual strain of the sheet in the respective conveying sections.

Then, the temperature difference strain calculating step S126 is to include the following respective steps:

a sheet-internal temperature distribution calculating step which calculates a temperature distribution in the thickness direction of the sheet after passing through the nip portion;

a sheet-internal moisture distribution calculating step which calculates a moisture content distribution in the thickness direction of the sheet after passing through the nip portion; and a temperature difference strain calculating step in which, first, the shrinkage rate of the front face and the back face of the sheet is calculated based on the temperature distribution and the moisture content distribution of the sheet after passing through the nip portion that is calculated in the sheet-internal temperature distribution calculating step and the moisture content distribution calculating step; a and, then, the strain difference of the front and the back of the sheet is calculated from the shrinkage rate of the front face and the back face of the sheet.

Figure 14:
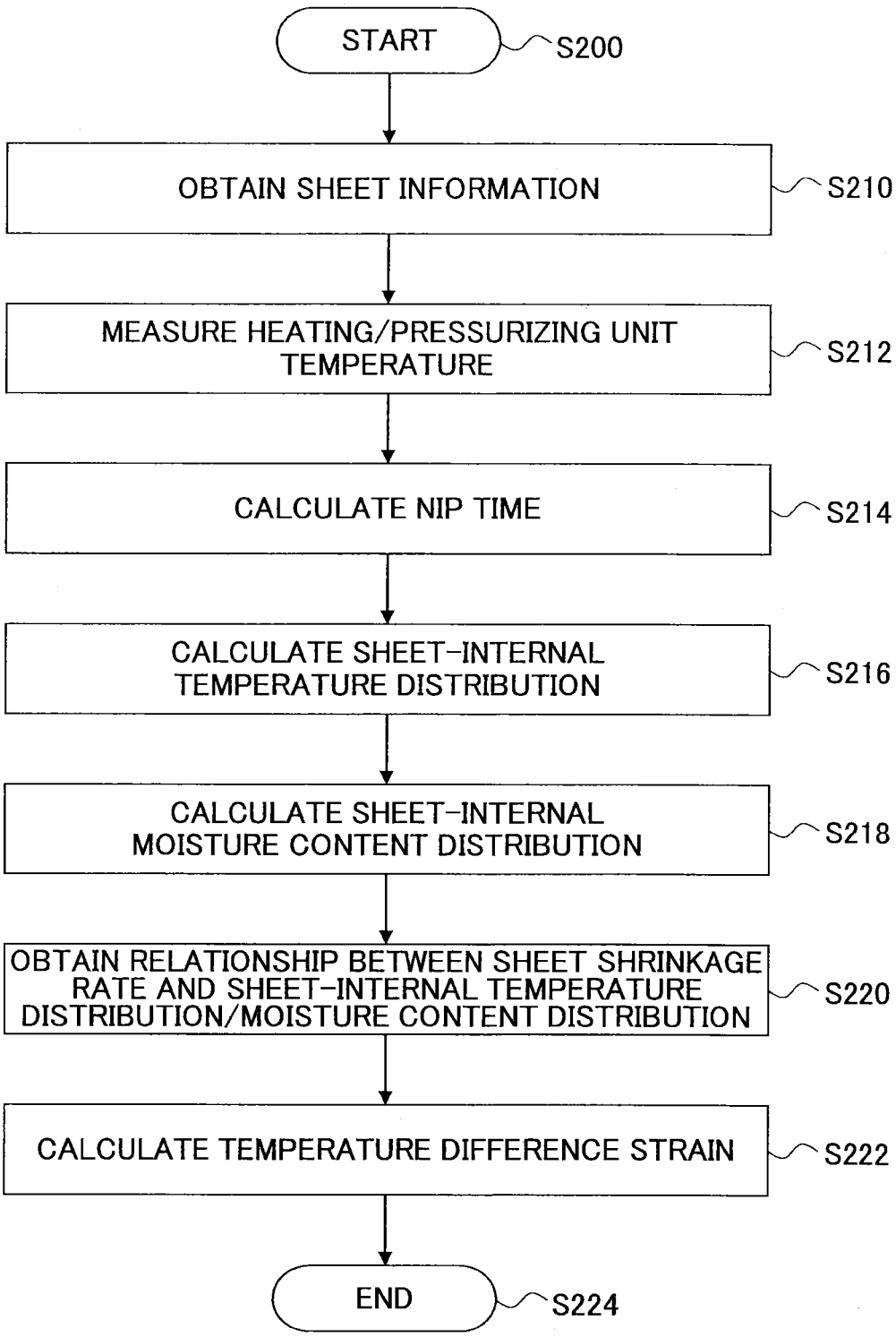
FIG. 14 is a flowchart of the step of calculating temperature difference strain according to the embodiment of the present invention.

Details of the temperature difference strain calculating step are described using FIG. 14 as a flowchart for determining the temperature difference strain in step S126 in FIG. 13. The flowchart in FIG. 14 starts from step S200 at appropriate timing in which step S126 in FIG. 13 can be handled.

In step S210, the CPU 112 reads data necessary in calculations from the sheet information storage unit 214.

In step S212, output values are obtained from the heating unit side temperature sensor 36 and the pressurizing unit side temperature sensor 39.

In step S214, a nip time of the nip portion 35 of the fixing apparatus is calculated.

The process up to here is determined between steps S110 and S120 in FIG. 13.

In step S216, which is a sheet-internal temperature distribution calculating step, the CPU 112 calculates the temperature distribution in the thickness direction of the sheet after passing through the nip portion. In calculating, the nip time of the nip portion 35 of the fixing apparatus obtained in S214; and the output values from the heating unit side temperature sensor 36 and pressurizing unit side temperature sensor 39 that are obtained in S212 may be used.

In step S218, which is a sheet-internal moisture content distribution calculating step, the CPU 112 calculates the moisture content distribution in the thickness direction of the sheet after passing through the nip portion. In calculating, the nip time obtained in S214; temperature information of the heating roller 30 and the pressurizing roller 37 that are obtained in S212; the initial temperature and moisture content of the sheet that are obtained in S114; and data such as the thickness, etc., that are stored in the sheet information storage unit 214 may be used.

In step S220, the CPU 112 obtains, via the sheet information storage unit 214, a relationship among the temperature distribution, moisture content distribution, and shrinkage rate within the sheet that are stored in the sheet information DB 208.

Step S222 is a temperature difference strain calculating step. In the above-mentioned step, the CPU 112 first calculates the shrinkage rate of the front face and the back face of the sheet based on the temperature distribution and the moisture content distribution in the thickness direction of the sheet after passing through the nip portion that is calculated in the sheet-internal temperature distribution calculating step (S216) and the moisture content distribution calculating step (S218). The shrinkage rate may be calculated based on the relationship (for example, what is provided in a table or a function in advance) among the temperature distribution, moisture content distribution, and the shrinkage rate within the sheet that is obtained in S220, for example.

Then, the strain difference of the front and the back of the sheet is calculated from the shrinkage rate of the front face and the back face of the sheet.

Figure 15:
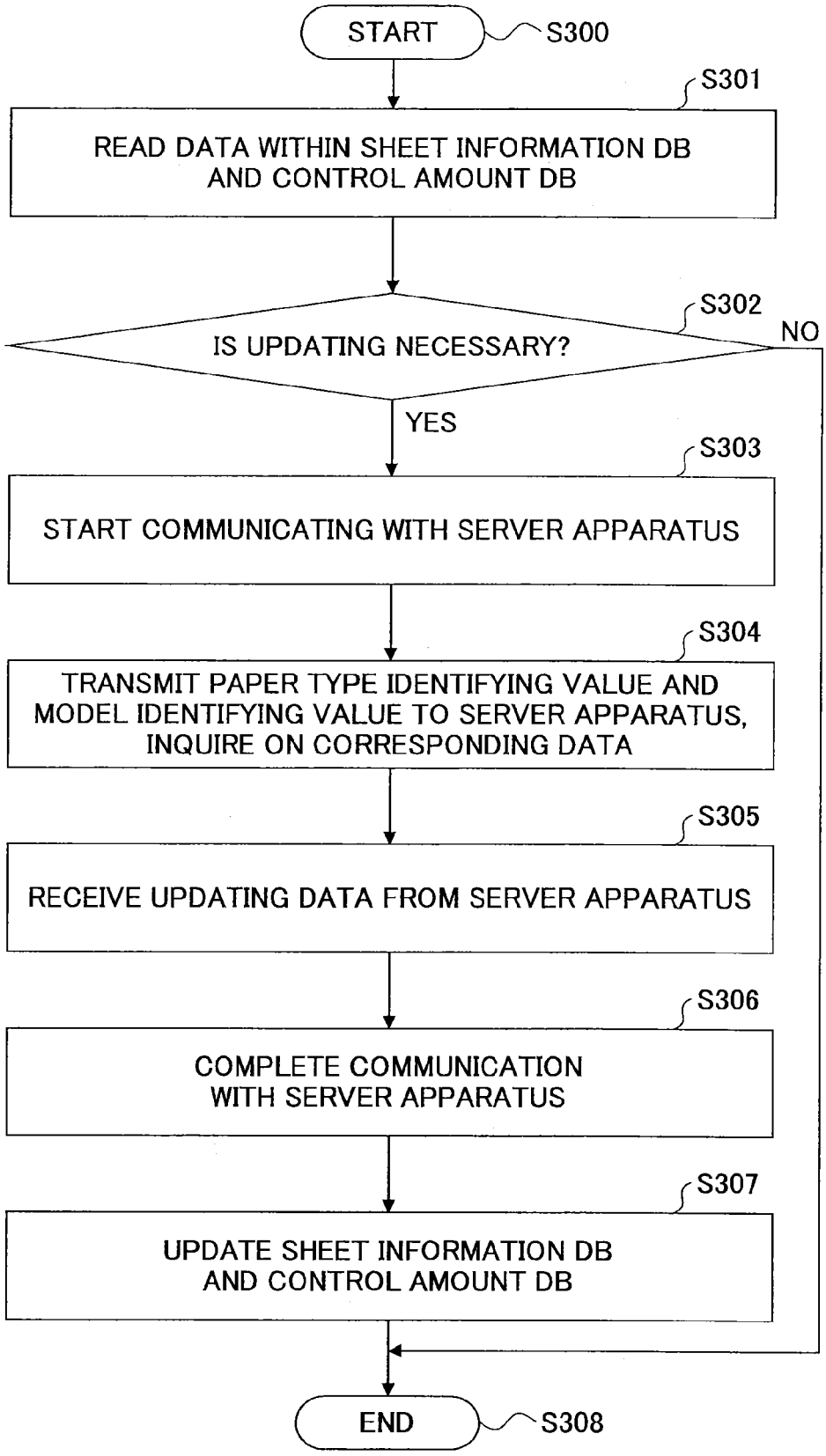
FIG. 15 is a flowchart of an updating process according to the embodiment of the present invention.

FIG. 15 is a flowchart showing the update process executed by the image forming apparatus according to the present embodiment.

The update process may be performed at arbitrary timing as described above. For example, it may be performed when it is detected that the setting of the sheet information storage unit 214 is changed from the input unit 216 and that there are no curl calculating data which correspond to the type identifying value. It may also be performed upon detecting an arrival of scheduled timing regardless of the setting change. Moreover, the process is started from step S300 upon detecting an update process executing instruction from an operator. When the updating process is started, the update processing unit 218 reads the sheet information DB 208 and the sheet information DB 210 in step S301 and determines whether updating is necessary in step S302.

Here, it is determined that updating is necessary when there is no data necessary for calculation and control corresponding to the type identifying value newly set from the input unit 216, for example. Data necessary for calculation and control herein includes, for example, a function or a table of the temperature/humidity and the moisture content near the paper surface; a function or a table of the stress relaxation characteristics; a function or a table of the shrinkage rate relative to the temperature and moisture content, the thickness and the paper type of the sheet information DB 208. Moreover, a function or a table of the straightening control value in the control amount DB 210 may also be listed. Furthermore, regardless of the input unit 216, it is possible to determine that updating is necessary even when there are table data for which an effective period has expired.

Then, in step S302, when it is determined that updating is necessary (YES), the process proceeds to step S303.

Next, in step S303, the update processing unit 218 starts communicating with the server apparatus 150.

Then, in step S304, the type identifying value of the present image forming apparatus and the type identifying value of the sheet for which it is determined that updating is necessary are transmitted to the server apparatus and inquires about corresponding constant, function, or table.

In step S305, the update processing unit 218 receives, from the server apparatus, updating data including a function or a table, etc., which corresponds to the model identifying value of the image forming apparatus and the type identifying value of the sheet that are transmitted to the server apparatus in S304.

In step S306, communication with the server apparatus is completed.

In step S307, the update processing unit 218 updates data within the sheet information DB 208 in accordance with updating data received.

In step S308, the present updating process is completed. On the other hand, in step S302, when it is determined that there is no need for updating (NO), the process is directly branched to step S308, where the present updating process is completed. As described above, a curl straightening method and an image forming apparatus which make it possible to project a produced curl amount in response to changes in factors affecting the production of curl with changes in the operating conditions of the image forming apparatus and realize curl straightening in response thereto.

The type of the image forming apparatus is not particularly limited. It may be any image forming apparatus which includes a curl straightening apparatus which straightens deformation of a curl, etc., of a sheet; and a fixing apparatus which causes the sheet on which an image is formed to pass through a nip portion formed by a heating unit and a pressurizing unit to fix the image onto the sheet. For example, it may be applied to a copying machine, a printer, a facsimile apparatus, etc.

A method of forming an image is not limited to the above-described electro-photographic technique, so that it may be an inkjet technique, for example. For the inkjet image forming apparatus, a similar advantageous effect is obtained also for the image forming apparatus including a fixing apparatus which conveys a sheet and dries ink by pressing a heated member against it to speedily dry ink after printing.

Moreover, it is not limited to a color image forming apparatus, so that it may be a monochrome image forming apparatus.

The present application is based on and claims priority of Japanese Priority Application No. 2013-030192 filed on Feb. 19, 2013, the entire contents of which are hereby incorporated by reference.

The invention claimed is:

1. A curl straightening method in an image apparatus including a fixing apparatus which includes a nip portion formed by a heating unit which heats one face side of a sheet and a pressurizing unit which presses the sheet to the heating unit side and a curl straightening apparatus which is arranged on a conveying path of the sheet from the fixing apparatus to a paper-discharging outlet to straighten a curl of the sheet, the curl straightening method comprising:

a sheet moisture content calculating step of calculating moisture content of the sheet before being supplied to the fixing apparatus;

a temperature measuring step of measuring a temperature of the heating unit and the pressurizing unit; a sheet temperature/moisture content calculating step of calculating a temperature and moisture content of the sheet in the respective conveying sections of multiple conveying sections into which are divided a conveying path from the nip portion to the paper-discharging outlet such that a curvature rate of the conveying path in the respective conveying sections is constant;

a conveying time calculating step of calculating a conveying time of the sheet in the respective conveying sections;

a conveying section strain calculating step of calculating a residual strain of the sheet in the respective conveying sections from the temperature and the moisture content of the sheet in the respective conveying sections that are calculated in the sheet temperature/moisture content calculating step, the conveying time calculated in the conveying time calculating step, and the stress relaxation characteristics of the sheet; a final curl amount calculating step of calculating a final curl amount using the residual strain of the sheet in the respective conveying sections that is calculated in the conveying section strain calculating step; and a curl straightening apparatus controlling step of controlling the curl straightening apparatus based on the final curl amount obtained in the final curl amount calculating step.

2. The curl straightening method as claimed in claim 1, further comprising: a temperature difference strain calculating step which calculates a temperature difference strain produced due to a temperature difference between a front face and a back face of the sheet in the nip portion, wherein, in the final curl calculating step, a final curl amount is calculated using the temperature difference strain and the residual strain of the sheet in the respective conveying sections, and wherein the temperature difference strain calculating step includes a sheet-internal temperature distribution calculating step which calculates a temperature distribution in a thickness direction of the sheet after passing through the nip portion;

a sheet-internal moisture content distribution calculating step which calculates a moisture content distribution in the thickness direction of the sheet after passing through the nip portion; and a temperature difference strain calculating step which calculates a shrinkage rate of a front face and a back face of the sheet based on the temperature distribution and the moisture content distribution in the thickness direction of the sheet after passing through the nip portion that are calculated in the sheet-internal temperature distribution calculating step and the moisture-content distribution calculating step and which calculates a strain difference of a front and a back of the sheet from the shrinkage rate of the front face and the back face of the sheet.

3. An image forming apparatus, comprising: a fixing apparatus including a nip portion formed by a heating unit which heats one face side of a sheet and a pressurizing unit which presses the sheet to the heating unit side; a curl straightening apparatus which is arranged on a conveying path of the sheet from the fixing apparatus to a paper-discharging outlet to straighten a curl of the sheet;

a sheet moisture content calculating unit which calculates moisture content of the sheet before being supplied to the fixing apparatus;

a heating unit side temperature sensor which measures a temperature of the heating unit; a pressurizing unit side temperature sensor which measures a temperature of the pressurizing unit;

sheet temperature/moisture content calculating unit which calculates a temperature and moisture content of the sheet in the respective conveying sections of multiple conveying sections into which are divided a conveying path from the nip portion to the paper-discharging outlet such that a curvature rate of the conveying path in the respective conveying sections is constant; a conveying time calculating unit which calculates a conveying time of the sheet in the respective conveying sections; a conveying section strain calculating unit which calculates a residual strain of the sheet in the respective conveying sections from the temperature and the moisture content of the sheet in the respective conveying sections that are calculated in the sheet temperature/moisture content calculating unit, the conveying time calculated in the conveying time calculating unit, and the stress relaxation characteristics of the sheet; a final curl amount calculating unit which calculates a final curl amount using the residual strain of the sheet in the respective conveying sections calculated in the conveying section strain calculating unit;

a curl straightening apparatus control value determining unit which determines a control value of the curl straightening apparatus based on a final curl amount calculated by the final curl amount calculating unit; and a curl straightening apparatus control unit which controls the curl straightening apparatus based on a control value determined by the curl straightening apparatus control value determining unit.

4. The image forming apparatus as claimed in claim 3, further comprising:

a temperature difference strain calculating unit which calculates a temperature difference strain produced by a temperature difference between a front face and a back face of the sheet in the nip portion, wherein, in the final curl calculating unit, a final curl amount is calculated using the temperature difference strain; and a residual strain of the sheet in the respective conveying sections; and wherein the temperature difference strain calculating unit includes a sheet-internal temperature distribution calculating unit which calculates a temperature distribution in the thickness direction of the sheet after passing through the nip portion; a moisture content distribution calculating unit which calculates a moisture content distribution in the thickness direction of the sheet after passing through the nip portion; and a temperature difference strain calculating unit which calculates a shrinkage rate of the front face and the back face of the sheet based on the temperature distribution and the moisture content distribution in the thickness distribution of the sheet after passing through the nip portion that are calculated by the sheet-internal temperature distribution calculating unit and the moisture content distribution calculating unit and calculates a strain difference of a front and a back of the sheet from the shrinkage rate of the front face and the back face of the sheet.

* * * * *